US010794561B2

(12) United States Patent
Inoue et al.

(10) Patent No.: US 10,794,561 B2
(45) Date of Patent: Oct. 6, 2020

(54) VEHICLE LAMP

(71) Applicant: KOITO MANUFACTURING CO., LTD., Tokyo (JP)

(72) Inventors: Takashi Inoue, Shizuoka (JP); Kazushi Kawaguchi, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/062,396

(22) PCT Filed: Dec. 13, 2016

(86) PCT No.: PCT/JP2016/087125
§ 371 (c)(1),
(2) Date: Jun. 14, 2018

(87) PCT Pub. No.: WO2017/104679
PCT Pub. Date: Jun. 22, 2017

(65) Prior Publication Data

US 2018/0372294 A1 Dec. 27, 2018

(30) Foreign Application Priority Data

Dec. 15, 2015 (JP) ..... 2015-244414
Dec. 15, 2015 (JP) ..... 2015-244415
Dec. 15, 2015 (JP) ..... 2015-244416

(51) Int. Cl.
*F21V 29/74* (2015.01)
*F21S 41/25* (2018.01)
(Continued)

(52) U.S. Cl.
CPC ..... *F21S 41/25* (2018.01); *F21S 41/147* (2018.01); *F21S 41/148* (2018.01);
(Continued)

(58) Field of Classification Search
CPC ..... F21S 41/25; F21S 41/39; F21S 41/143; F21S 41/00; F21S 41/147; F21S 41/148;
(Continued)

(56) References Cited

U.S. PATENT DOCUMENTS

2005/0077616 A1* 4/2005 Ng ..... H01L 23/36 257/707
2006/0120094 A1 6/2006 Tsukamoto et al.
(Continued)

FOREIGN PATENT DOCUMENTS

CN 103119356 A 5/2013
CN 103836478 A 6/2014
(Continued)

OTHER PUBLICATIONS

Search Report dated Mar. 14, 2017 by the International Searching Authority in counterpart International Patent Application No. PCT/JP2016/087125. (PCT/ISA/210).
(Continued)

*Primary Examiner* — William J Carter
*Assistant Examiner* — Omar Rojas Cadima
(74) *Attorney, Agent, or Firm* — Sughrue Mion, PLLC

(57) ABSTRACT

A vehicle lamp includes a projector lens, a first light source disposed behind the projector lens and configured to emit light for forming a low-beam light distribution pattern, a second light source disposed behind the projector lens and configured to emit light for forming an additional high-beam light distribution pattern, and a metal base member. The base member includes a first surface on which the first light source is disposed and a second surface on which the second light source is disposed. The second surface is inclined with respect to an optical axis such that an emission portion of the light emitting element faces obliquely forward and upward. A plurality of metal plate-shaped fins extending in a left-
(Continued)

right direction and an upper-lower direction of the lamp are arranged along a front-rear direction of the lamp on a rear surface of the first and second surfaces.

17 Claims, 8 Drawing Sheets

(51) Int. Cl.

| | |
|---|---|
| ***F21S 41/255*** | (2018.01) |
| ***F21S 41/663*** | (2018.01) |
| ***F21S 41/147*** | (2018.01) |
| ***F21S 41/43*** | (2018.01) |
| ***F21S 45/43*** | (2018.01) |
| ***F21S 41/151*** | (2018.01) |
| ***F21S 41/148*** | (2018.01) |
| ***F21V 29/503*** | (2015.01) |
| ***F21V 29/67*** | (2015.01) |
| ***F21V 29/75*** | (2015.01) |
| *F21Y 115/10* | (2016.01) |
| *F21S 41/39* | (2018.01) |

(52) U.S. Cl.
CPC ..... *F21S 41/151* (2018.01); *F21S 41/255* (2018.01); *F21S 41/43* (2018.01); *F21S 41/663* (2018.01); *F21S 45/43* (2018.01); *F21V 29/503* (2015.01); *F21V 29/67* (2015.01); *F21V 29/75* (2015.01); *F21S 41/39* (2018.01); *F21Y 2115/10* (2016.08)

(58) Field of Classification Search
CPC ..... F21S 41/151; F21S 41/153; F21S 43/00; F21V 29/67; F21V 29/503; F21V 29/75; F21V 29/74; F21Y 2115/10; H01L 33/64
See application file for complete search history.

(56) References Cited

U.S. PATENT DOCUMENTS

| | | | | |
|---|---|---|---|---|
| 2007/0201241 | A1* | 8/2007 | Komatsu ..... | F21S 41/143 362/545 |
| 2008/0117647 | A1 | 5/2008 | Behr et al. | |
| 2009/0195186 | A1* | 8/2009 | Guest ..... | H05B 33/0803 315/294 |
| 2013/0107564 | A1 | 5/2013 | Yatsuda | |
| 2013/0201707 | A1 | 8/2013 | Suzuki et al. | |
| 2014/0140085 | A1 | 5/2014 | Matsumoto | |
| 2014/0321145 | A1* | 10/2014 | Anzai ..... | F21S 41/192 362/516 |
| 2014/0321147 | A1 | 10/2014 | Todaka et al. | |
| 2014/0328079 | A1* | 11/2014 | Itagaki ..... | F21V 29/02 362/547 |
| 2014/0340922 | A1 | 11/2014 | Matsumoto | |
| 2015/0325740 | A1 | 11/2015 | Serita et al. | |
| 2016/0195233 | A1 | 7/2016 | Lin et al. | |

FOREIGN PATENT DOCUMENTS

| | | | |
|---|---|---|---|
| CN | 105782843 | A | 7/2016 |
| EP | 2157364 | A1 | 2/2010 |
| EP | 2623850 | A1 | 8/2013 |
| EP | 2733412 | A2 | 5/2014 |
| EP | 3040601 | A1 | 7/2016 |
| JP | 2006-164735 | A | 6/2006 |
| JP | 2007-227228 | A | 9/2007 |
| JP | 2013-30372 | A | 2/2013 |
| JP | 2014-056792 | A | 3/2014 |
| JP | 2014-216164 | A | 11/2014 |
| JP | 2014-229361 | A | 12/2014 |
| JP | 2015-216214 | A | 12/2015 |
| JP | 2015-220035 | A | 12/2015 |

OTHER PUBLICATIONS

Written Opinion dated Mar. 14, 2017 by the International Searching Authority in counterpart International Patent Application No. PCT/JP2016/087125. (PCT/ISA/237).

Communication dated Jul. 10, 2019, from the European Patent Office in counterpart European Application No. 16875656.7.

Office Action dated Feb. 3, 2020 by the State Intellectual Property of P.R. China in counterpart Chinese Patent Application No. 201680073169.7.

* cited by examiner

VEHICLE LAMP

TECHNICAL FIELD

The disclosure relates to a vehicle lamp such as a projector type vehicle lamp.

BACKGROUND ART

Conventionally, in order to reduce a size, a vehicle lamp includes a projector type optical system using a single projector lens and is capable of selectively performing a low-beam irradiation and a high-beam irradiation (see Patent Document 1).

PRIOR ART DOCUMENT

Patent Document

Patent Document 1: JP-A-2006-164735

SUMMARY OF THE INVENTION

Problems to be Solved by the Invention

In the lamp disclosed in Patent Document 1, at a high beam is irradiation, an additional high-beam light distribution pattern is added to a low-beam light distribution pattern. In the configuration of the lamp disclosed in Patent Document 1, a base table on which a light source (low-beam light source) configured to emit light for forming a low-beam light distribution pattern is disposed and a base table on which a light source (high-beam light source) configured to emit light for forming an additional high-beam light distribution pattern is disposed are common. Therefore, at a high-beam irradiation, the heat radiation performed through the base tables becomes not sufficient, and the low-beam light source and the high-beam light source may be likely to become high temperature.

Further, in the lamp disclosed in Patent Document 1, a projector lens is supported by a lens holder at its outer peripheral flange portion. The lens holder has an arm portion extending rearward of the lamp and a leg portion extending downward of the lamp. Further, the lens holder is configured such that the arm portion is fixed to an upper surface of a base member by bolts or the like and the leg portion is supported by an extension portion extending forward of the lamp at the lower side of the base member. In the configuration of Patent Document 1, the extension portion becomes an obstacle, for example, when arranging a power feeding connector or a power feeding cable for a light source, and, in some cases, the degree of freedom in designing these lamp parts may be reduced.

Accordingly, a first object of the disclosure is to provide a vehicle lamp capable of suppressing a low-beam light source and a high-beam light source from being heated to a high temperature.

A second object of the disclosure is to provide a vehicle lamp capable of improving the degree of freedom in designing the position where each part of a lamp is attached to a base member.

Means for Solving the Problems

A vehicle lamp according to a first aspect of the disclosure is configured to selectively perform a low-beam irradiation and a high-beam irradiation. The vehicle lamp includes:

a projector lens;

a first light source disposed behind the projector lens and configured to emit light for forming a low-beam light distribution pattern;

a second light source disposed behind the projector lens and configured to emit light for forming an additional high-beam light distribution pattern; and a metal base member on which the first light source and the second light source are disposed, wherein the base member includes a first surface on which the first light source is disposed and a second surface on which the second light source is disposed, wherein the second surface is an inclined surface inclined with respect to an optical axis of the projector lens such that an emission portion of the second light source disposed on the second surface faces obliquely forward and upward, and wherein a plurality of metal plate-shaped fins extending in a left-right direction of the lamp and an upper-lower direction of the lamp are arranged along a front-rear direction of the lamp on a rear surface of the first surface and a rear surface of the second surface of the base member.

According to the above configuration, the air passing between the fins is easy to be released in the left-right direction of the lamp, and the heat radiation can be efficiently performed. Further, since the base member has the inclined surface and the fins are also formed on the rear surface thereof, even at the high-beam irradiation, the heat generated from the second light source can be sufficiently released to the outside via the fins.

In the vehicle lamp according to the first aspect of the disclosure, the first surface may include a first mounting surface on which the first light source is mounted, and a thickness of the base member defined by a distance between the first mounting surface and the rear surface of the first surface may be larger than a thickness of the base member defined by a distance between a surface on the first surface where the first light source is not mounted and the rear surface of the first surface.

According to the above configuration, the heat generated from the first light source can be efficiently radiated.

In the vehicle lamp according to the first aspect of the disclosure, the second surface may include a second mounting surface on which the second light source is mounted, and a thickness of the base member defined by a distance between the second mounting surface and the rear surface of the second surface may be larger than a thickness of the base member defined by a distance between a surface on the second surface where the second light source is not mounted and the rear surface of the second surface.

According to the above configuration, the heat generated from the second light source can be efficiently radiated.

The vehicle lamp according to the first aspect of the disclosure may further include an air cooling fan, and the air cooling fan may be disposed to face tip ends of the fins.

According to the above configuration, the air generated from the air cooling fan can be fed between the fins, and the heat radiation can be more efficiently performed.

In the vehicle lamp according to the first aspect of the disclosure, the plurality of fins may include short fins having a length in the upper-lower direction of the lamp shorter than those of the other fins, and the air cooling fan may be disposed to face tip ends of the short fins.

According to the above configuration, the size of the base member can be reduced, and the heat radiation can be efficiently performed even with the short fins.

In the vehicle lamp according to the first aspect of the disclosure, a pitch between the short fins may be smaller than a pitch between the other fins.

According to the above configuration, the surface area of the fins in the region where the short fins are formed can be increased, and the heat radiation can be efficiently performed.

In the vehicle lamp according to the first aspect of the disclosure, the second light source may include a plurality of light emitting elements and a metal substrate on which the plurality of light emitting elements are disposed, the substrate may be fixed to the second surface, and the plurality of light emitting elements may be disposed on the second surface via the substrate.

According to the above configuration, the heat generated from the light emitting elements can be efficiently transferred to the base member via the metal substrate.

In the vehicle lamp according to the first aspect of the disclosure, the plurality of light emitting elements may be arranged in the left-right direction below a rear focal point of the projector lens and configured to be individually turned on.

According to the above configuration, the heat of the light emitting elements can be efficiently transferred to the base member.

A vehicle lamp according to a second aspect of the disclosure includes:

a first light source;

a second light source;

one or more optical parts configured to irradiate light from the first light source and the second light source toward a front of the lamp; and a metal base member on which the first light source and the second light source are disposed, wherein the base member includes a first surface on which the first light source is disposed, a second surface on which the second light source is disposed, and a heat-radiation portion formed on a rear surface of the first surface and a rear surface of the second surface, wherein the second light source includes a light emitting element and a metal substrate on which the light emitting element is disposed, wherein a wiring pattern and a mounting portion provided for the wiring pattern are formed on the substrate, and the light emitting element is mounted on the mounting portion with a solder, wherein the first light source is fixed to the first surface by means different from a solder, and wherein in a state where the first light source and the second light source are turned on, a temperature of the solder is caused to be lower than a temperature of the first light source by the heat-radiation portion.

According to the above configuration, the heat generated from the first light source and the second light source can be sufficiently released to the outside via the heat-radiation portion of the base member on which the light sources are disposed. Therefore, the first light source and the second light source can be suppressed from being heated to a high temperature.

A vehicle lamp according to the second aspect of the disclosure includes:

a first light source;

a second light source;

one or more optical parts configured to irradiate light from the first light source and the second light source toward the front of the lamp; and a metal base member on which the first light source and the second light source are disposed, wherein the base member includes a first surface on which the first light source is disposed, a second surface on which the second light source is disposed, and a heat-radiation portion formed on a rear surface of the first surface and a rear surface of the second surface, and wherein in a state where the first light source and the second light source are turned on, the second light source has higher power consumption than the first light source, and a temperature of the second light source is caused to be lower than a temperature of the first light source by the heat-radiation portion.

According to the above configuration, the heat generated from the first light source and the second light source can be sufficiently released to the outside via the heat-radiation portion of the base member on which the light sources are disposed. Therefore, the first light source and the second light source can be suppressed from being heated to a high temperature.

A vehicle lamp according to the second aspect of the disclosure includes:

a first light source;

a second light source;

one or a plurality of optical parts configured to irradiate light from the first light source and the second light source toward the front of the lamp; and a metal base member on which the first light source and the second light source are disposed, wherein the base member includes a first surface on which the first light source is disposed, a second surface on which the second light source is disposed, and a heat-radiation portion formed on a rear surface of the first surface and a rear surface of the second surface, wherein the second light source includes a light emitting element and a metal substrate on which the light emitting element is disposed, wherein a wiring pattern and a mounting portion provided for the wiring pattern are formed on the substrate, and the light emitting element is mounted on the mounting portion with a solder and is supplied with power via the solder, wherein the first light source is supplied with power by means different from the solder on the first surface, and wherein in a state where the first light source and the second light source are turned on, a temperature of the solder is caused to be lower than a temperature of the first light source by the heat-radiation portion.

According to the above configuration, the heat generated from the first light source and the second light source can be sufficiently released to the outside via the heat-radiation portion of the base member on which the light sources are disposed. Therefore, the first light source and the second light source can be suppressed from being heated to a high temperature.

A vehicle lamp according to a third aspect of the disclosure includes:

a projector lens;

a lens holder configured to support the projector lens;

a first light source disposed behind the projector lens;

a second light source disposed behind the projector lens; and a base member on which the first light source and the second light source are disposed, wherein the base member includes a first surface on which the first light source is disposed and a second surface on which the second light source is disposed, wherein the lens holder includes an arm portion, wherein the arm portion includes a right arm portion extending from a right portion of the lens holder toward a front of the lamp and a left arm portion extending from a left portion of the lens holder toward the front of the lamp, wherein the right arm portion and the left arm portion are connected to each other, and wherein the arm portion is fixed to the first surface of the base member.

According to the above configuration, since the arm portion is fixed on the first surface, the arm portion is less likely to interfere with the parts on the second surface. Therefore, for example, the parts (power feeding connector or cable) associated with the second light source can be easily placed on the second surface, and the degree of freedom can be improved in designing the position where each part of the lamp is attached to the base member.

In the vehicle lamp according to the third aspect of the disclosure, the arm portion may be fixed on the first surface via at least three fixing portions.

According to the above configuration, even the structure in which the position of the center of gravity is biased from the center can be stably fixed to the base member.

In the vehicle lamp according to the third aspect of the disclosure, one of the at least three fixing portions may be formed on an end portion of the arm portion on a rear side of the lamp.

According to the above configuration, even the structure in which the position of the center of gravity is biased from the center can be stably fixed.

The vehicle lamp according to the third aspect of the disclosure may include a reflector configured to reflect light emitted from the first light source toward the projector lens, the reflector may be fixed on the arm portion.

According to the above configuration, the number of bosses provided on the base member can be reduced, and the heat radiation of the base member can be enhanced.

In the vehicle lamp according to the third aspect of the disclosure, in a state where the projector lens and the reflector are attached to the lens holder, a position of a center of gravity of a combined structure of the lens holder, the projector lens and the reflector may be located in front of a tip end of the first surface on a front side of the lamp.

According to the above configuration, the position of the center of gravity of the entire lamp can be brought close to the center of the entire lamp structure, and the stability of the lamp after installation can be improved.

In the vehicle lamp according to the third aspect of the disclosure, the second surface may be an inclined surface inclined with respect to an optical axis of the projector lens such that an emission portion of the second light source disposed on the second surface faces obliquely forward and upward and the emission portion of the second light source is disposed below a rear focal point of the projector lens.

According to the above configuration, most of light emitted from the second light source is allowed to pass through the vicinity of the rear focal point, the utilization efficiency of light of the second light source can be improved, and the size of the structure of the lamp can be reduced.

Further, in the vehicle lamp according to the third aspect of the disclosure, the second light source may include a plurality of light emitting elements and a substrate on which the plurality of light emitting elements are disposed, the substrate may be fixed to the second surface, and the plurality of light emitting elements may be disposed on the second surface via the substrate.

According to the above configuration, the heat generated from the plurality of light emitting elements can be efficiently transferred to the base member via the substrate, and the size of the structure of the lamp can be reduced.

The vehicle lamp according to the third aspect of the disclosure may further include an air cooling fan, a plurality of metal plate-shaped fins may be formed on a rear surface of the first surface and a rear surface of the second surface of the base member, the air cooling fan may be disposed to face tip ends of the fins, a part of the fixing portions for fixing the air cooling fan to the base member may include a protruding portion extending from above the first surface to an upper side of the lamp, and wherein the fixing portion formed in the end portion of the arm portion on the rear side of the lamp may be a fitting hole to be fitted to the protruding portion.

According to the above configuration, since the fitting hole of the arm portion of the lens holder is fitted and fixed to the protruding portion of the fixing portion of the base member and the air cooling fan can be also fixed to the same fixing portion, the length in the front-rear direction of the lamp can be shortened.

Effects of the Invention

According to the vehicle lamp of the first aspect of the disclosure, the low-beam light source and the high-beam light source can be suppressed from being heated to a high temperature.

According to the vehicle lamp of the second aspect of the disclosure, the light source can be suppressed from being heated to a high temperature.

According to the vehicle lamp of the third aspect of the disclosure, the degree of freedom can be improved in designing the position where each part of the lamp is attached to the base member.

DESCRIPTION OF EMBODIMENTS

First Embodiment

Hereinafter, as an example of a vehicle lamp 1 of the disclosure, a vehicle lamp 1A of a first embodiment will be described in detail with reference to the drawings.

Figure 1:
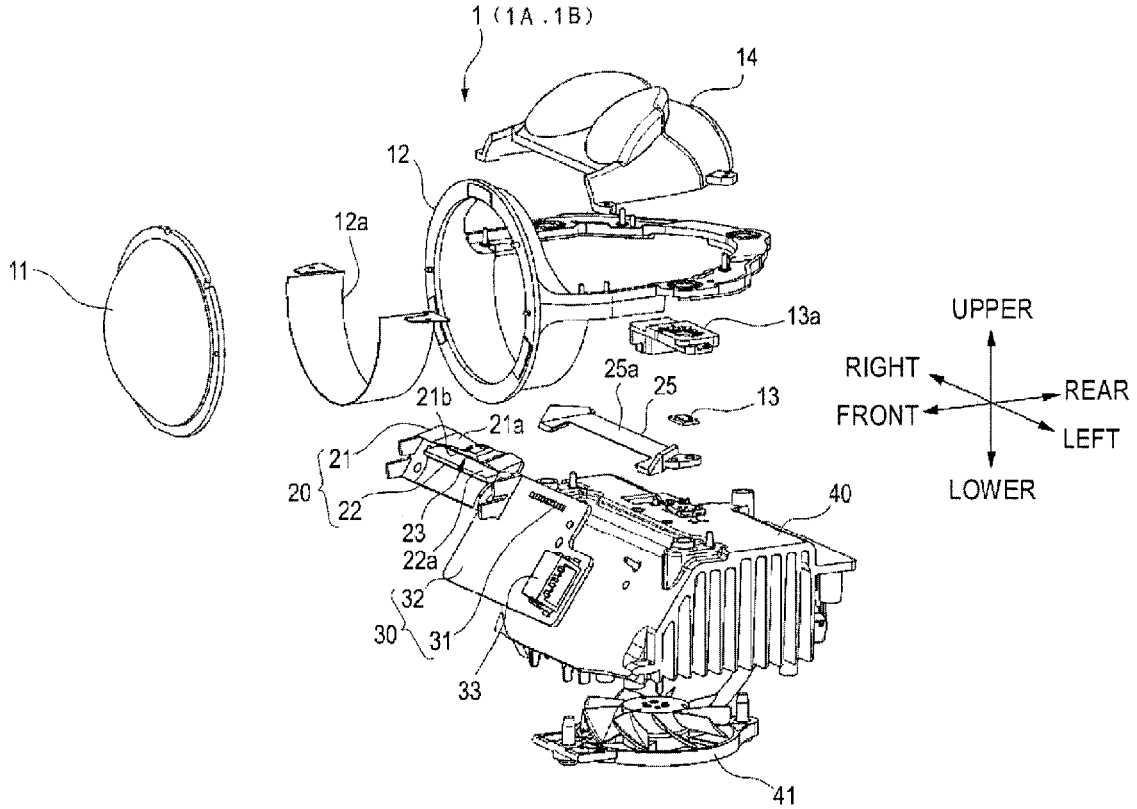
FIG. 1 is an exploded perspective view of a vehicle lamp 1A according to a first embodiment (hereinafter, simply referred to as the "first embodiment") of the disclosure and a vehicle lamp 1B according to a second embodiment (hereinafter, simply referred to as the "second embodiment") of the disclosure.
Figure 2:
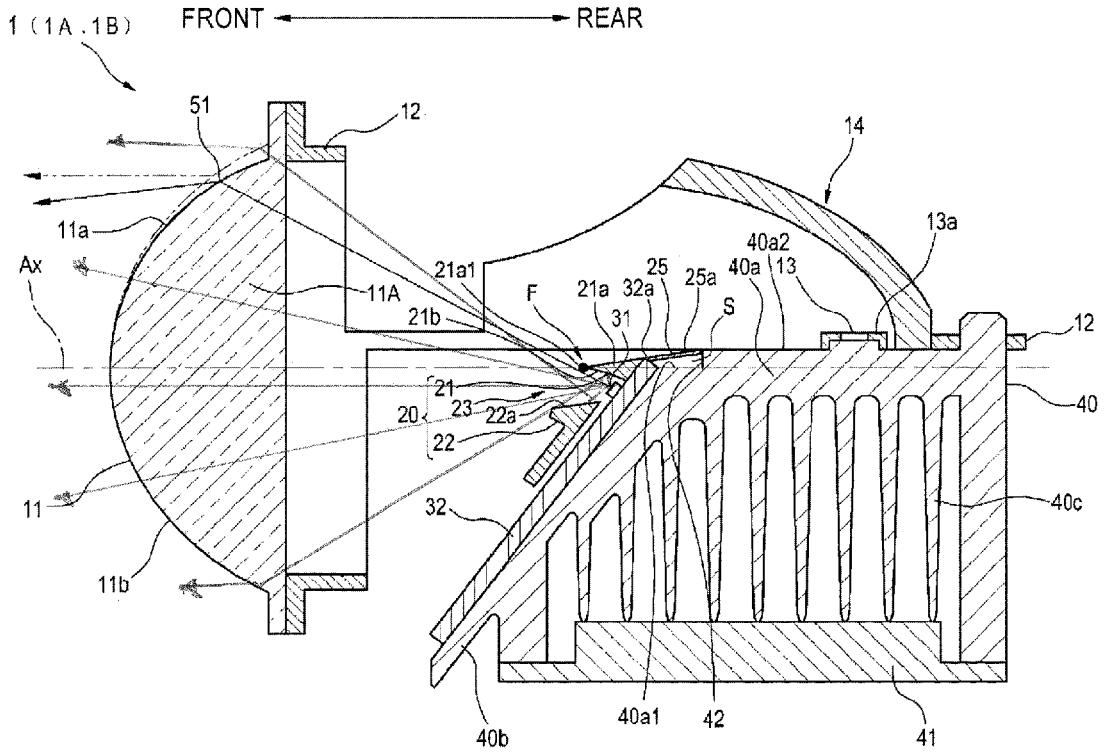
FIG. 2 is a view showing a vertical cross section of the lamp of FIG. 1, as viewed from a horizontal direction.

As shown in FIGS. 1 and 2, the vehicle lamp 1A includes a projector lens 11, a lens holder 12, a light emitting element (an example of a first light source) 13, a reflector 14, an optical member 20, a reflective member 25, a light source unit (an example of a second light source) 30, a base member 40, and an air cooling fan 41. Meanwhile, in FIG. 2, for ease of view, the shape of the reflector 14 is shown in a simplified manner.

The vehicle lamp 1A is, for example, a headlamp capable of selectively performing a low-beam irradiation and a high-beam irradiation and is configured as a projector type lamp unit.

The projector lens 11 has an optical axis Ax extending in a front-rear direction of a vehicle. The projector lens 11 is a plano-convex aspheric lens having a front convex surface and a rear flat surface. The projector lens 11 is configured to project a light source image formed on a rear focal plane which is a focal plane including a rear focal point F thereof, as an inverted image, on a virtual vertical screen in front of the lamp. In the first embodiment, the virtual vertical screen is disposed, for example, at a position of 25 m in front of the vehicle. Meanwhile, both the front surface and the rear surface of the projector lens 11 may be convex.

An optical path change portion 51 is formed in an upper exit surface 11*a* of the projector lens 11 of the first embodiment above the optical axis Ax. For example, the optical path change portion 51 is formed as a curvature processed surface which makes the radius of curvature of the upper exit surface 11*a* smaller than that of a lower exit surface lib below the optical axis Ax. Since the optical path change portion 51 is formed, the light emitted from the light source unit 30 and incident on an upper region 11A of the projector lens 11 is emitted from the upper exit surface 11*a* of the projector lens 11 in a state of being directed slightly downward, as compared with the case where the optical path change portion 51 is not formed (the exit surface indicated by the two-dot chain line in the figure).

The projector lens 11 is fixed to the lens holder 12 at its outer peripheral flange portion. The lens holder 12 for fixing the projector lens 11 is fixed to the base member 40. The extension 12*a* as a decorative member for concealing an inner wall surface of the lens holder 12 so as not to be visible from the outside is attached to the lens holder 12.

The light emitting element 13 is disposed behind the rear focal point F of the projector lens 11. The light emitting element 13 is configured by, for example, a white light emitting diode and has a laterally elongated rectangular light emitting surface. The light emitting element 13 is disposed upward with its light emitting surface positioned slightly above the horizontal plane including the optical axis Ax. The light emitting element 13 is fixed to the base member 40 via an attachment 13*a*. Light emitted from the light emitting element 13 is mainly incident on the region of the rear surface (incident surface) of the projector lens 11 positioned below the optical axis Ax and is emitted from the exit surface, thereby forming a low-beam light distribution pattern.

Meanwhile, in the first embodiment, the "low-beam light distribution pattern" and the "additional high-beam light distribution pattern" (to be described later) mean light distribution patterns formed on a virtual vertical screen disposed, for example, at a position of 25 m in front of the vehicle.

The reflector 14 is disposed so as to cover the light emitting element 13 from the upper side and configured to reflect light from the light emitting element 13 toward the projector lens 11. A reflective surface of the reflector 14 for reflecting light has an axis connecting the rear focal point F and a light emission center of the light emitting element 13. The reflective surface is formed by a substantially elliptical curved surface having the light emission center of the light emitting element 13 as a first focal point. The reflective surface is set such that its eccentricity gradually increases from a vertical cross section toward a horizontal cross section. The reflector 14 is fixed to the lens holder 12.

The light source unit 30 includes a plurality of light emitting elements 31 and a substrate 32 made of a metal (e.g., copper).

The light emitting elements 31 are mounted on the substrate 32 and arranged in the left-right direction at the lower rear side of the rear focal point F of the projector lens 11. Each of the light emitting elements 31 is configured by, for example, a white light emitting diode and has a square light emission surface (emission portion), for example.

In the first embodiment, eleven light emitting elements 31 are arranged on the substrate 32. For example, the light emitting elements 31 are arranged at equal intervals in the left-right direction and centered on the position directly below the optical axis Ax. Each of the light emitting elements 31 is connected to a power supply terminal (e.g., a connector or the like) 33 via a wiring pattern formed on the substrate 32 and can be individually tuned on under the control of a lighting control circuit (not shown). Light emitted from the light emitting elements 31 is incident on substantially the entire area of the incident surface of the projector lens 11 and emitted from the exit surface, thereby forming an additional high-beam light distribution pattern. The light of each light emitting element 31 directed toward the projector lens 11 passes through its rear focal plane with a certain extent. The range of the bundle of light beams slightly overlaps between adjacent light emitting elements. Meanwhile, the light emitting elements 31 may not be arranged in a bilaterally symmetrical manner with respect to the position directly below the optical axis Ax. Further, the light emitting elements 31 may not be arranged at equal intervals.

Each of the light emitting elements 31 is connected to the power supply terminal (e.g., a power feeding connector or the like) 33 via a wiring pattern formed on the substrate 32. The power supply terminal 33 is connected to a lighting control circuit (not shown) via a connection cable and is configured to be individually turned on by controlling the lighting control circuit.

The optical member 20 is disposed behind the projector lens 11 and has a plate-shaped upper plate portion 21 and a plate-shaped lower plate portion 22 arranged in parallel in a substantially horizontal manner with a predetermined interval in the upper-lower direction. A spaced interval between the upper plate portion 21 and the lower plate portion 22 serves as an opening 23 through which the light emitted from the light emitting elements 31 passes. The optical member 20 is formed of aluminum die cast or transparent polycarbonate resin or the like having excellent heat resistance.

An upper surface of the upper plate portion 21 constitutes an upward reflective surface 21*a* which shields a part of light emitted from the light emitting element 13 and reflected by the reflector 14 and reflects the shielded light toward the projector lens 11. The upper reflective surface 21*a* functions as a shade and also functions as a reflector. The upward reflective surface 21*a* is formed so as to be inclined slightly forward and downward with respect to the horizontal plane including the optical axis Ax.

A left area of the upward reflective surface 21*a* located on the left side (the right side in the front view of the lamp) of the optical axis Ax is configured by an inclined surface inclined obliquely upward and rearward from the position of the horizontal plane including the optical axis Ax. A right area of the upward reflective surface 21*a* located on the right side (the left side in the front view of the lamp) of the optical axis Ax is configured by an inclined surface which is lower than the left area by one step via a short inclined surface. A front end edge 21*a*1 of the upward reflective surface 21*a* is formed so as to extend from the position of the rear focal point F toward the left and right sides.

A lower surface of the upper plate portion 21 on the side opposite to the upper surface constitutes a downward reflective surface 21*b* which reflects a part of light emitted obliquely upward and forward from the light emitting elements 31 toward the projector lens 11 on the front side. The downward reflective surface 21*b* is formed so as to extend rearward and slightly downward from the front end edge 21*a*1 of the upward reflective surface 21*a* to a position near upper portions of the light emitting elements 31.

An upper surface of the lower plate portion 22 constitutes a reflective surface 22*a* which reflects a part of light emitted obliquely downward and forward from the light emitting elements 31 toward the projector lens 11 on the front side. The reflective surface 22*a* is formed so as to extend rearward and slightly upward from an obliquely lower front side of the light emitting elements 31 to a position near lower portions of the light emitting elements 31.

The upward reflective surface 21*a* and the downward reflective surface 21*b* of the upper plate portion 21 and the reflective surface 22*a* of the lower plate portion 22 are mirror-finished by aluminum vapor deposition or the like.

The optical member 20 is fixed, together with the substrate 32, to the base member 40 in a state where the substrate 32 is interposed between the optical member 20 and the base member 40. In a state where the optical member 20 is fixed to the base member 40, each of the light emitting elements 31 mounted on the substrate 32 is arranged such that its light emission surface is exposed from the opening 23 of the optical member 20 obliquely upward (toward the front of the lamp) with respect to the front direction of the lamp. An upper end portion 32*a* of the substrate 32 fixed to the base member 40 is arranged so as to protrude upward beyond the optical axis Ax of the projector lens 11.

The reflective member 25 is formed in a flat plate shape and disposed behind the upper plate portion 21 so as to be continuous with the upper plate portion 21. The upper surface of the reflective member 25 constitutes an upward reflective surface 25*a* which shields a part of light emitted from the light emitting element 13 and reflected by the reflector 14 and then reflects the shielded light toward the projector lens 11. The upward reflective surface 25*a* is mirror-finished by aluminum vapor deposition or the like. The reflective member 25 is provided so as to be inclined slightly forward and downward with respect to the horizontal plane including the optical axis Ax. Further, the reflective member 25 is disposed so as to cover the upper end portion 32*a* of the substrate 32 from above and is fixed to the base member 40.

The base member 40 is formed of a metal (e.g., aluminum, copper, or the like) and has an upper wall portion 40*a* extending in the horizontal direction and an inclined wall portion 40*b* extending obliquely downward and forward from a front end of the upper wall portion 40*a*. A stepped portion 42 is formed on the upper wall portion 40*a*. A lower portion of the upper wall portion 40*a* on the front side of the stepped portion 42 is defined as a front upper wall portion 40*a*1, and a higher portion thereof on the rear side of the stepped portion 42 is defined as a rear upper wall portion 40*a*2. The reflective member 25 is fixed on an upper surface of the front upper wall portion 40*a*1, and the light emitting element 13 is fixed on an upper surface of the rear upper wall portion 40*a*2. Further, the optical member 20 and the substrate 32 on which the light emitting elements 31 are mounted are fixed to an upper surface of the inclined wall portion 40*b*.

A plurality of metal plate-shaped heat-radiation fins 40*c* extending in the upper-lower direction of the lamp and the left-right direction of the lamp is arranged along the front-rear direction of the lamp on the rear surface of the upper wall portion 40*a* and the rear surface of the inclined wall portion 40*b*. The base member 40 is arranged such that the position of the upper surface of the front upper wall portion 40*a*1 is defined as the position of the horizontal plane including the optical axis Ax.

In a state where the optical member 20 is fixed to the base member 40, the upward reflective surface 21*a* of the upper plate portion 21 is disposed so as to connect the rear focal point F and the upper end portion 32*a* of the substrate 32. Further, the upward reflective surface 25*a* of the reflective member 25 is disposed so as to connect the upper end portion 32*a* of the substrate 32 and a tip end of the rear upper wall portion 40*a*2. In this case, since the stepped portion 42 is provided in the base member 40, a space S is formed between the reflective member 25 and the front upper wall portion 40*a*1. The upper end portion 32*a* of the substrate 32 disposed above the optical axis Ax is accommodated in the space S.

The air cooling fan 41 is provided below the base member 40 and disposed to face tip ends of the heat-radiation fins 40*c*. The wind (air) generated from the air cooling fan 41 is sent to the heat-radiation fins 40*c* extending downward from the lower side.

Meanwhile, in a state where the adjustment of the optical axis is completed, the vehicle lamp 1A is configured so that the optical axis Ax is provided slightly downward with respect to the front-rear direction of the vehicle, for example.

Figure 3:
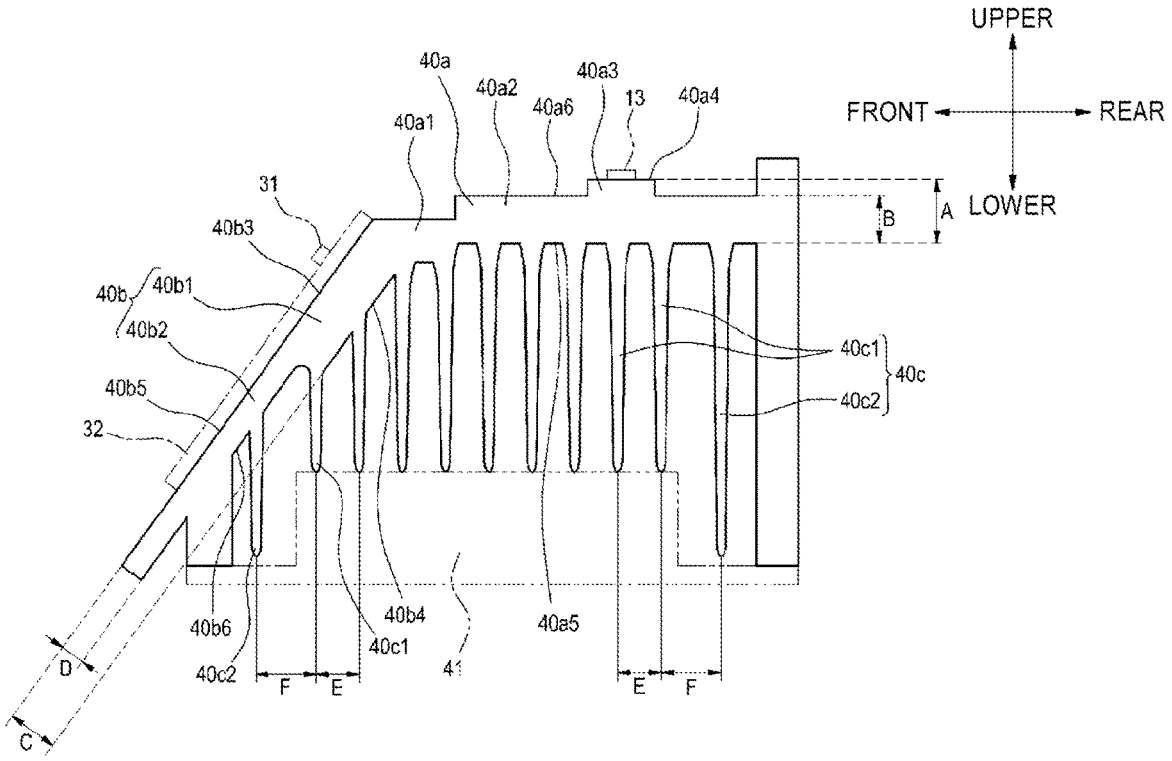
FIG. 3 is a view for explaining a base member used in the vehicle lamp shown in FIG. 1.

Next, the base member 40 of the vehicle lamp 1A will be further described with reference to FIG. 3. FIG. 3 shows a cross-sectional view of the base member 40.

A first mounting portion 40*a*3 on which the light emitting element 13 is mounted is provided on the rear upper wall portion 40*a*2 of the base member 40. The first mounting portion 40*a*3 is formed to be higher than the rear upper wall portion 40*a*2 by one step. Therefore, a thickness A of a wall portion defined by a distance between an upper surface (an example of a first mounting surface) 40*a*4 of the first mounting portion 40*a*3 and a rear surface 40*a*5 of the rear upper wall portion 40*a*2 is greater than a thickness B of a wall portion defined by a distance between an upper surface 40*a*6 of the portion of the rear upper wall portion 40*a*2 where the first mounting portion 40*a*3 is not formed and the rear surface 40*a*5 of the rear upper wall portion 40*a*2.

A second mounting portion 40*b*1 on which the light emitting elements 31 are mounted is provided on the inclined wall portion 40*b* of the base member 40. A thickness C of a wall portion defined by a distance between an upper surface (an example of a second mounting surface) 40*b*3 and a rear surface 40*b*4 of the second mounting portion 40*b*1 is greater than a thickness D of a wall portion defined by a distance between an upper surface 40*b*5 and a rear surface 40*b*6 of a wall portion 40*b*2 where the light emitting elements 31 are not mounted.

The heat-radiation fins 40*c* formed on rear surfaces of the upper wall portion 40*a* and the inclined wall portion 40*b* include short funs 40*c*1 having a short length in the upper-lower direction of the lamp and long fins 40*c*2 having a long length in the upper-lower direction of the lamp. A pitch E (fin-to-fin distance) between the adjacent short fins 40*c*1 is formed to be smaller (narrower) than a pitch F between the long fin 40*c*2 and the fin adjacent thereto.

The air cooling fan 41 is fitted to a concave region generated by the formation of the short fins 40*c*1, is disposed to face tip ends of the short fins 40*c*1, and is attached to the base member 40.

Second Embodiment

Next, as an example of the vehicle lamp 1 of the disclosure, a vehicle lamp 1B of a second embodiment will be described in detail with reference to the drawings.

As shown in FIGS. 1 and 2, the vehicle lamp 1B includes the projector lens 11 (an example of an optical part), the lens holder 12, the light emitting element (an example of a first light source) 13, the reflector 14, the optical member 20, the reflective member 25, the light source unit (an example of a second light source) 30, the base member 40, and the air cooling fan 41.

The vehicle lamp 1B of the present embodiment is, for example, a headlamp capable of selectively performing a low-beam irradiation and a high-beam irradiation and can be configured as a projector type lamp.

Meanwhile, the example to which the disclosure is applied is not limited to this embodiment. For example, the disclosure may be applied to a parabola type lamp unit, for example. Further, the disclosure is not limited to a headlamp capable of selectively performing a low-beam irradiation and a high-beam irradiation, but may be applied to lamps for other uses, such as DRL (Daytime Running Lamps), clearance lamps and fog lamps.

Since the configurations of the projector lens 11, the lens holder 12, the reflector 14, the optical member 20, the reflective member 25, the base member 40, and the air cooling fan 41 of the second embodiment are the same as those of the first embodiment, these parts are denoted by the same reference numerals and description thereof will be omitted.

Similar to the first embodiment, the light emitting element 13 is disposed behind the rear focal point F of the projector lens 11. The light emitting element 13 is configured by, for example, a white light emitting diode and has a laterally elongated rectangular light emitting surface. The light emitting element 13 is disposed upward with its light emitting surface positioned slightly above the horizontal plane including the optical axis Ax. The light emitting element 13 is fixed to the base member 40 via the attachment 13*a*.

Specifically, the light emitting element 13 includes a substrate. A white light emitting diode constituting the light emitting element 13 is fixed on the substrate by means such as laser welding. In a state where the substrate is in contact with a terminal of the attachment 13*a*, the attachment 13*a* is fixed to the base member 40 by means such as screws. In this way, the white light emitting diode constituting the light emitting element 13 is fixed on the base member 40 by means different from a solder. Further, the white light emitting diode constituting the light emitting element 13 is supplied with power from a power feeding unit (not shown) via the terminal or the like of the attachment 13*a* in a state where no solder is interposed in a power feeding path.

Similar to the first embodiment, light emitted from the light emitting element 13 is mainly incident on the region of the rear surface (incident surface) of the projector lens 11 positioned below the optical axis Ax and is emitted from the exit surface, thereby forming a low-beam light distribution pattern. Meanwhile, in this example, the "low-beam light distribution pattern" and the "additional high-beam light distribution pattern" (to be described later) mean light distribution patterns formed on a virtual vertical screen disposed, for example, at a position of 25 m in front of the vehicle.

Similar to the first embodiment, the light source unit 30 includes a plurality of light emitting elements 31 and a substrate 32 made of a metal (e.g., copper).

The light emitting elements 31 are mounted on the substrate 32 and arranged in the left-right direction at the lower rear side of the rear focal point F of the projector lens 11. Each of the light emitting elements 31 is configured by, for example, a white light emitting diode and has a square light emission surface (emission portion), for example.

Similar to the first embodiment, in the second embodiment, eleven light emitting elements 31 are arranged on the substrate 32. For example, the light emitting elements 31 are arranged at equal intervals in the left-right direction and centered on the position directly below the optical axis Ax. Each of the light emitting elements 31 is connected to a power supply terminal (e.g., a connector or the like) 33 via a wiring pattern formed on the substrate 32 and can be individually tuned on under the control of a lighting control circuit (not shown). Light emitted from the light emitting elements 31 is incident on substantially the entire area of the incident surface of the projector lens 11 and emitted from the exit surface, thereby forming an additional high-beam light distribution pattern.

The total power consumption of the eleven light emitting elements 31 to be turned on at the time of forming the additional high-beam light distribution pattern is higher than the power consumption of the light emitting element 13 to be turned on at the time of forming a low-beam light distribution pattern.

Similar to the first embodiment, in the second embodiment, the light of each light emitting element 31 directed toward the projector lens 11 passes through its rear focal plane with a certain extent. The range of the bundle of light beams slightly overlaps between adjacent light emitting elements. Meanwhile, the light emitting elements 31 may not be arranged in a bilaterally symmetrical manner with respect to the position directly below the optical axis Ax. Further, the light emitting elements 31 may not be arranged at equal intervals.

Similar to the first embodiment, in the second embodiment, the base member 40 is formed of a metal (e.g., iron, aluminum, copper, or the like) and has an upper wall portion 40*a* extending in the horizontal direction and an inclined wall portion 40*b* extending obliquely downward and forward from a front end of the upper wall portion 40*a*. A stepped portion 42 is formed on the upper wall portion 40*a*. A lower portion of the upper wall portion 40*a* on the front side of the stepped portion 42 is defined as a front upper wall portion 40*a*1, and a higher portion thereof on the rear side of the stepped portion 42 is defined as a rear upper wall portion 40*a*2. The reflective member 25 is fixed on an upper surface of the front upper wall portion 40*a*1, and the light emitting element 13 is fixed on an upper surface of the rear upper wall portion 40*a*2. Further, the optical member 20 and the substrate 32 on which the light emitting elements 31 are mounted are fixed to an upper surface of the inclined wall portion 40*b*.

The plurality of metal plate-shaped heat-radiation fins (an example of a heat-radiation portion) 40*c* extending in the upper-lower direction of the lamp and the left-right direction of the lamp is arranged along the front-rear direction of the lamp on the rear surface of the upper wall portion 40*a* and the rear surface of the inclined wall portion 40*b*. The base member 40 is arranged such that the position of the upper surface of the front upper wall portion 40*a*1 is defined as the position of the horizontal plane including the optical axis Ax.

Next, the substrate 32 of the vehicle lamp 1B will be further described with reference to FIG. 4.

Figure 4:
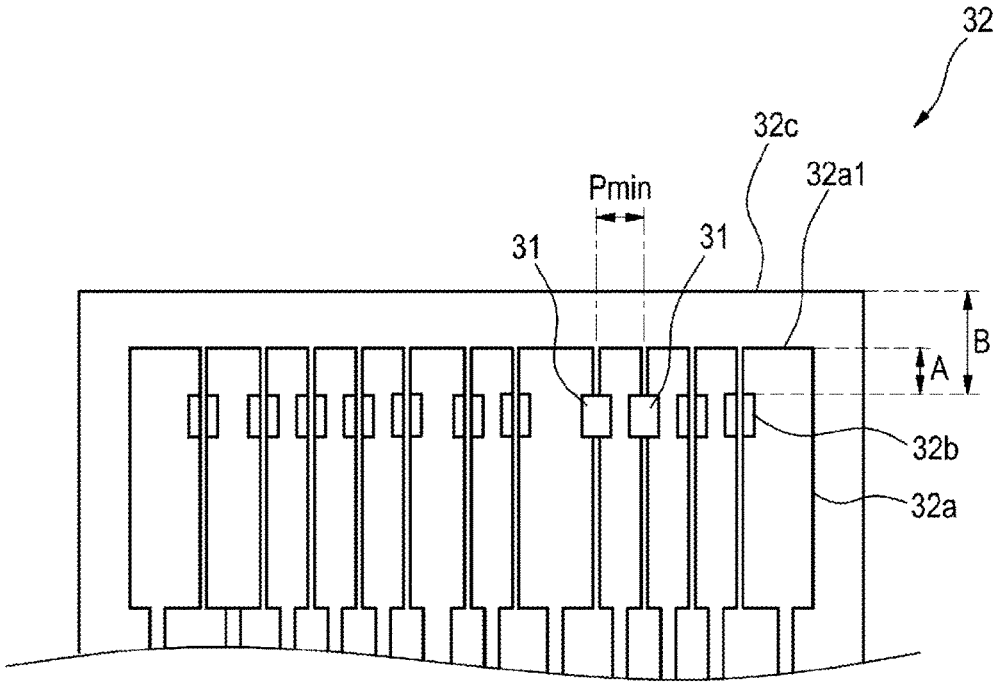
FIG. 4 is a view for explaining a substrate used in the vehicle lamp 1B according to the second embodiment.

As shown in FIG. 4, a plurality of wiring patterns (copper foil patterns) 32*a* and mounting portions (solder lands) 32*b* provided on each of the wiring patterns 32*a* are formed on the substrate 32. Electrodes of the light emitting elements 31 are mounted with a solder between the mounting portions 32*b* of the adjacent wiring patterns 32*a*. Meanwhile, FIG. 4 shows a state in which two light emitting elements 31 are mounted. In this way, the light emitting elements 31 are fixed on the substrate 32 via a solder and are supplied with power from a power feeding unit (not shown).

As shown in FIG. 4, the substrate 32 is formed so as to meet the following conditions (1) and (2) when a shortest distance between the mounting portions 32*b* and end portions 32*a*1 of the wiring patterns 32*a* is defined as A, a shortest distance between the mounting portions 32*b* and an end portion 32*c* of the substrate 32 is defined as B, and a minimum arrangement pitch between the mounted light emitting elements 31 is defined as Pmin.

(1) The ratio (A/Pmin) of the shortest distance A to the minimum arrangement pitch Pmin is 0.5 or more (A/Pmin>0.57).

(2) The ratio (B/Pmin) of the shortest distance B to the minimum arrangement pitch Pmin is 1.7 or more (B/Pmin>1.7).

Third Embodiment

Next, as an example of the vehicle lamp 1 of the disclosure, a vehicle lamp 1C of a third embodiment will be described in detail with reference to the drawings.

Figure 5:
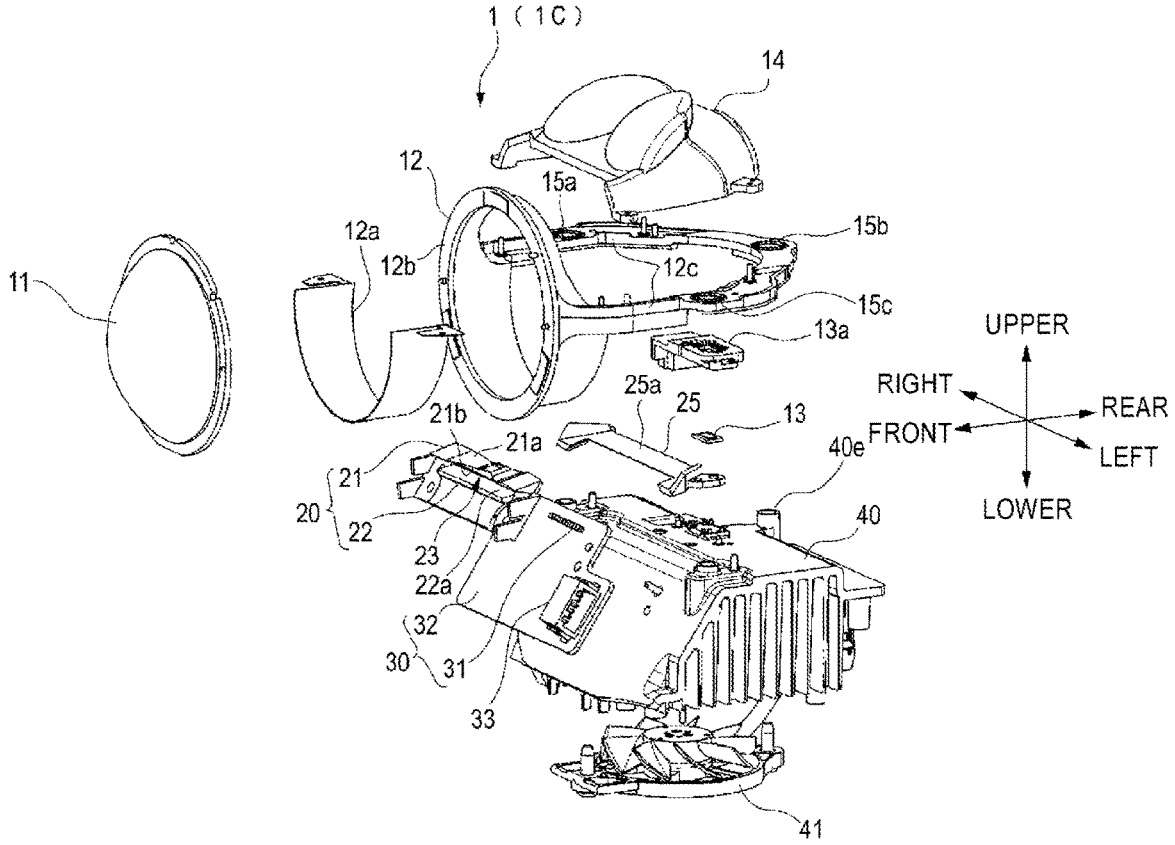
FIG. 5 is an exploded perspective view of a vehicle lamp 1C according to a third embodiment (hereinafter, simply referred to as the "third embodiment") of the disclosure.
Figure 6:
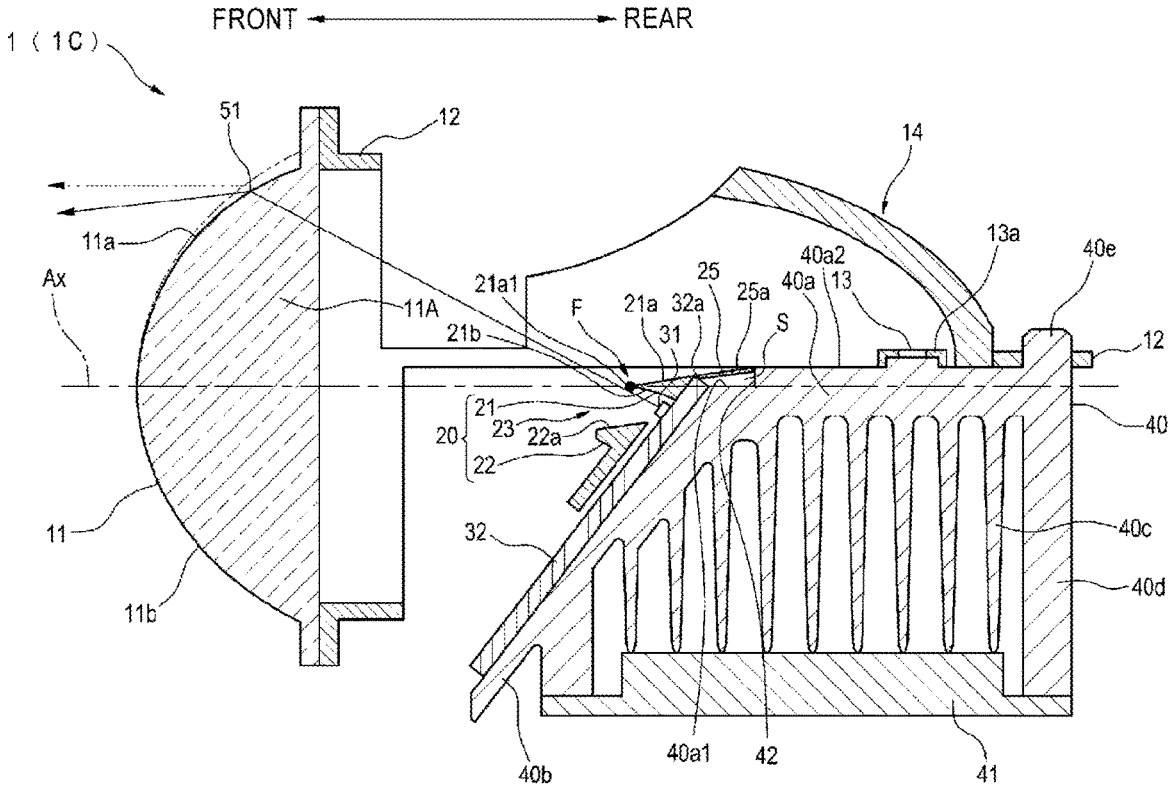
FIG. 6 is a view showing a vertical cross section of the lamp of FIG. 5, as viewed from a horizontal direction.

As shown in FIGS. 5 and 6, the vehicle lamp 1C includes the projector lens 11, the lens holder 12, the light emitting element (an example of a first light source) 13, the reflector 14, the optical member 20, the reflective member 25, the light source unit (an example of a second light source) 30, the base member 40, and the air cooling fan 41. Meanwhile, in FIG. 6, for ease of view, the shape of the reflector 14 is shown in a simplified manner.

The vehicle lamp 1C of the present embodiment is, for example, a headlamp capable of selectively performing a low-beam irradiation and a high-beam irradiation and can be configured as a projector type lamp.

Since the configurations of the light emitting element 13, the optical member 20, the reflective member 25, the light source unit 30, the base member 40, and the air cooling fan 41 of the third embodiment are the same as those of the first embodiment, these parts are denoted by the same reference numerals and description thereof will be omitted.

Similar to the first embodiment, in the third embodiment, the projector lens 11 has an optical axis Ax extending in a front-rear direction of a vehicle. The projector lens 11 is a plano-convex aspheric lens having a front convex surface and a rear flat surface. The projector lens 11 is configured to project a light source image formed on a rear focal plane which is a focal plane including a rear focal point F thereof, as an inverted image, on a virtual vertical screen in front of the lamp. In this example, the virtual vertical screen is disposed, for example, at a position of 25 m in front of the vehicle.

The projector lens 11 is fixed to the lens holder 12 at its outer peripheral flange portion. Meanwhile, both the front surface and the rear surface of the projector lens 11 may be convex.

Similar to the first embodiment, the optical path change portion 51 is formed in the upper exit surface 11*a* of the projector lens 11 of the third embodiment above the optical axis Ax. For example, the optical path change portion 51 is formed as a curvature processed surface which makes the radius of curvature of the upper exit surface 11*a* smaller than that of the lower exit surface 11*b* below the optical axis Ax. Since the optical path change portion 51 is formed, the light emitted from the light source unit 30 and incident on the upper region 11A of the projector lens 11 is emitted from the upper exit surface 11*a* of the projector lens 11 in a state of being directed slightly downward, as compared with the case where the optical path change portion 51 is not formed (the exit surface indicated by the two-dot chain line in the figure).

The reflector 14 is disposed so as to cover the light emitting element 13 from the upper side and configured to reflect light from the light emitting element 13 toward the projector lens 11. A reflective surface of the reflector 14 for reflecting light has an axis connecting the rear focal point F and a light emission center of the light emitting element 13. The reflective surface is formed by a substantially elliptical curved surface having the light emission center of the light emitting element 13 as a first focal point. The reflective surface is set such that its eccentricity gradually increases from a vertical cross section toward a horizontal cross section. The reflector 14 is fixed on an arm portion 12*c* of the lens holder 12.

Similar to the first embodiment, in the third embodiment, the base member 40 is formed of a metal (e.g., iron, aluminum, copper, or the like) and has the upper wall portion 40*a* extending in the horizontal direction and the inclined wall portion 40*b* extending obliquely downward and forward from a front end of the upper wall portion 40*a*. The stepped portion 42 is formed on the upper wall portion 40*a*. A lower portion of the upper wall portion 40*a* on the front side of the stepped portion 42 is defined as the front upper wall portion 40*a*1, and a higher portion thereof on the rear side of the stepped portion 42 is defined as the rear upper wall portion 40*a*2. The reflective member 25 is fixed on an upper surface of the front upper wall portion 40*a*1, and the light emitting element 13 is fixed on an upper surface of the rear upper wall portion 40*a*2. Further, the optical member 20 and the substrate 32 on which the light emitting elements 31 are mounted are fixed to an upper surface of the inclined wall portion 40*b*.

The plurality of metal plate-shaped heat-radiation fins 40*c* extending in the upper-lower direction of the lamp and the left-right direction of the lamp is arranged along the front-rear direction of the lamp on the rear surface of the upper wall portion 40*a* and the rear surface of the inclined wall portion 40*b*.

Further, fixing portions 40*d* for fixing the air cooling fan 41 to the base member 40 are formed at both front-rear end portions of the base member 40. An upper portion of the fixing portion 40*d* formed on the rear end portion constitutes a protruding portion 40*e* protruding from an upper surface of the upper wall portion 40*a* and extending upward of the lamp.

Similar to the first embodiment, the base member 40 is arranged such that the position of the upper surface of the front upper wall portion 40*a*1 is defined as the position of the horizontal plane including the optical axis Ax.

In a state where the optical member 20 is fixed to the base member 40, similar to the first embodiment, the upward reflective surface 21*a* of the upper plate portion 21 of the third embodiment is disposed so as to connect the rear focal point F and the upper end portion 32*a* of the substrate 32. Further, similar to the first embodiment, the upward reflective surface 25*a* of the reflective member 25 of the third embodiment is disposed so as to connect the upper end portion 32*a* of the substrate 32 and a tip end of the rear upper wall portion 40*a*2. In this case, since the stepped portion 42 is provided in the base member 40, the space S is formed between the reflective member 25 and the front upper wall portion 40*a*1. The upper end portion 32*a* of the substrate 32 disposed above the optical axis Ax is accommodated in the space S.

Similar to the first embodiment, in the third embodiment, the air cooling fan 41 is provided below the base member 40 and disposed to face tip ends of the heat-radiation fins 40*c*. The air cooling fan 41 is fixed to the fixing portions 40*d* of the base member 40. The wind (air) generated from the air cooling fan 41 is sent to the heat-radiation fins 40*c* extending downward from the lower side.

The lens holder 12 has a holding portion 12*b* for holding an outer peripheral flange portion of the projector lens 11 and the arm portion 12*c* extending rearward from the holding portion 12*b*. The lens holder 12 is fixed to the base member 40 via the arm portion 12*c*. The extension 12*a* as a decorative member for concealing an inner wall surface of the lens holder 12 so as not to be visible from the outside is attached to the lens holder 12.

Figure 7:
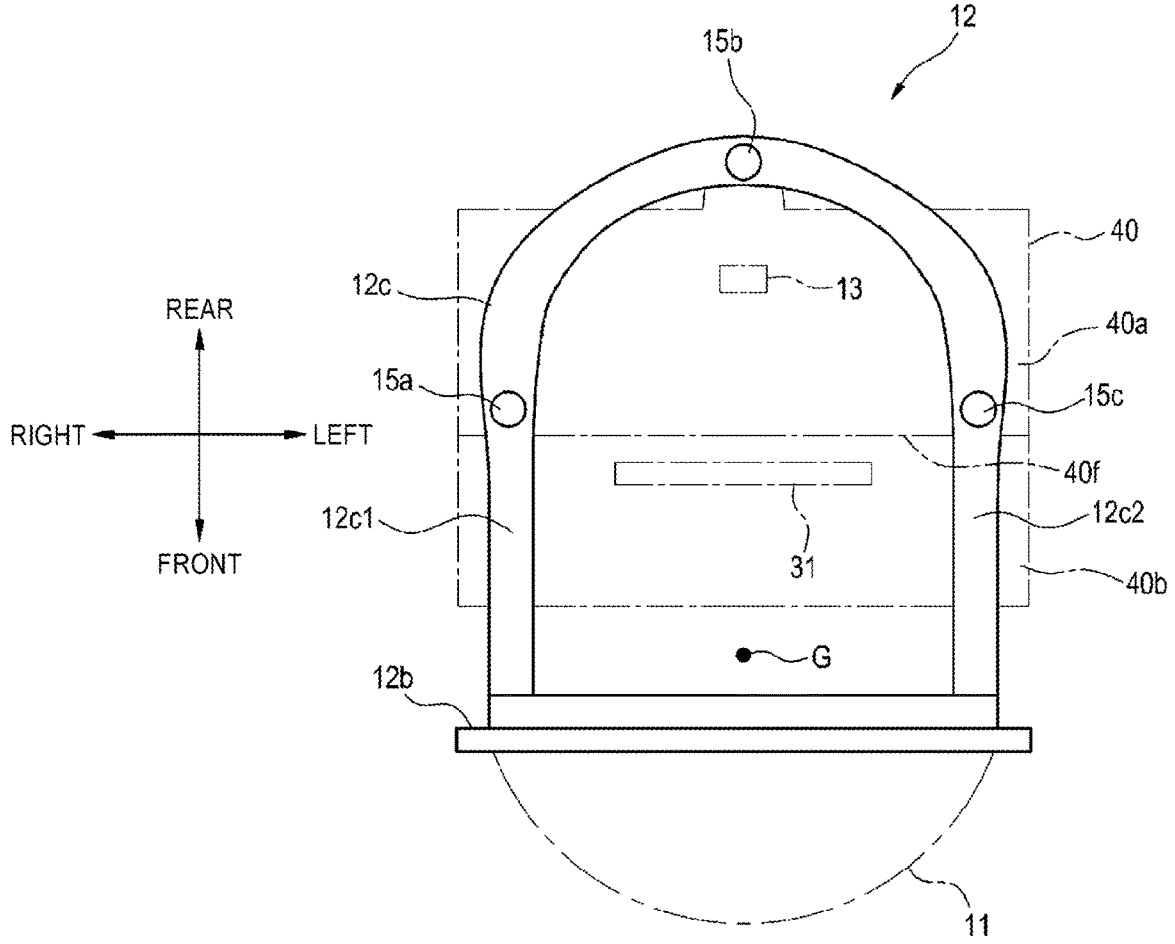
FIG. 7 is a view for explaining a lens holder used in the vehicle lamp shown in FIG. 5.

The lens holder 12 of the vehicle lamp 1C will be further described with reference to FIG. 7. FIG. 7 shows a top view of the lens holder 12.

The arm portion 12*c* of the lens holder 12 includes a right arm portion 12*c*1 extending substantially in the horizontal direction from a right portion of the holding portion 12*b* toward the rear of the lamp and a left arm portion 12*c*2 extending substantially in the horizontal direction from a left portion of the holding portion 12*b* toward the rear of the lamp. The right arm portion 12*c*1 and the left arm portion 12*c*2 are curved in a direction facing each other and connected to each other on the rear side of the lamp, thereby forming a semi-annular arm portion 12*c*.

The arm portion 12*c* has a plurality of (three in this example) fixing portions 15*a*, 15*b*, 15*c*. At least one (the fixing portion 15*b* in this example) of the fixing portions is formed in an end portion of the arm portion 12*c* on the rear side of the lamp. Further, the other fixing portions (the fixing portions 15*a*, 15*c*) are formed in the right arm portion 12*c*1 and the left arm portion 12*c*2. The arm portion 12*c* is fixed to the upper wall portion 40*a* of the base member 40 via the fixing portions 15*a*, 15*h*, 15*c*.

The fixing portions 15*a*, 15*b*, 15*c* are formed, for example, as fitting holes. The fitting hole of the fixing portion 15*b* formed in the end portion on the rear side of the lamp is configured as a fitting hole to be fitted to the protruding portion 40*e* extending upward from the upper surface of the upper wall portion 40*a*.

In a state where the projector lens 11 and the reflector 14 are attached to the lens holder 12 having such a configuration, the position of the center of gravity G of a structure configured by the lens holder 12, the projector lens 11 and the reflector 14 is closer to the front side of the structure due to the weight of the projector lens 11. When the structure is fixed to the upper wall portion 40*a* of the base member 40, the position of the center of gravity G of the structure is located in front of the lamp from a tip end 40*f* of the upper wall portion 40*a* on the front side of the lamp.

<Light Distribution Pattern>

Figure 8A:
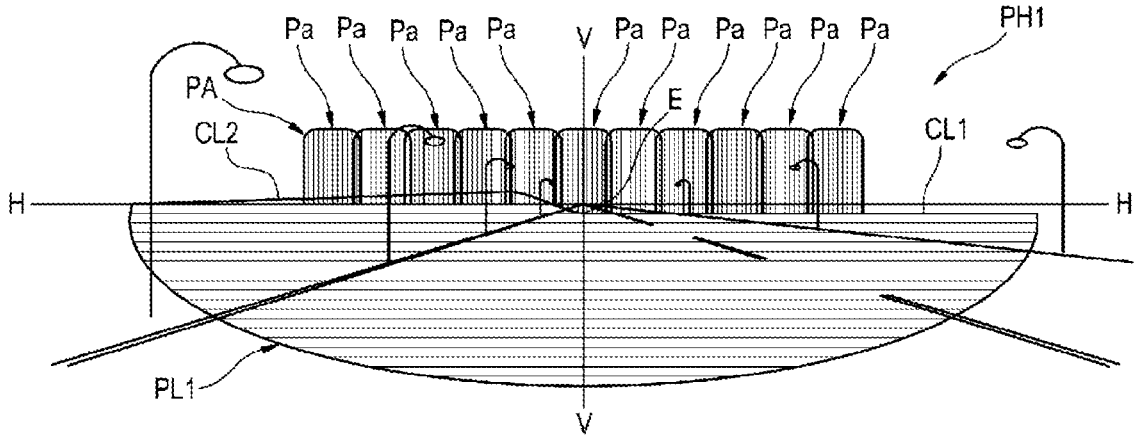
FIGS. 8A and 8B are views perspectively showing light distribution patterns which are formed on a virtual vertical screen disposed in front of the lamp by light irradiated from the vehicle lamps 1A to 1C.
Figure 8B:
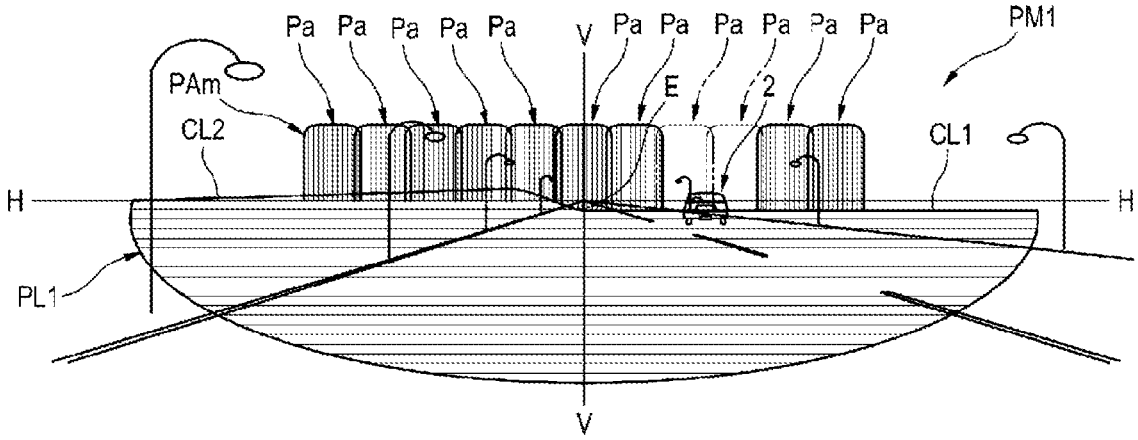

FIGS. 8A and 8B are views perspectively showing light distribution patterns which are formed on a virtual vertical screen disposed at a position of 25 m in front of the vehicle by light irradiated forward from the vehicle lamps 1A to 1C (hereinafter, simply referred to as the "vehicle lamp 1") according to the first to third embodiments. FIG. 8A shows a high-beam light distribution pattern PH1, and FIG. 8B shows an intermediate light distribution pattern PM1. The high-beam light distribution pattern PH1 shown in FIG. 8A is formed as a combined light distribution pattern of the low-beam light distribution pattern PL1 and the additional high-beam light distribution pattern PA.

The low-beam light distribution pattern PL1 is a low-beam light distribution pattern of left light distribution and has the cutoff lines CL1, CL2 with different left and right levels at its upper end edge. The cutoff lines CL1, CL2 extend substantially horizontally with different left and right levels with a V-V line as a boundary. The V-V line vertically passes through a point H-V that is a vanishing point in the front direction of the lamp. An oncoming vehicle-lane side portion on the right side of the V-V line is formed as a lower stage cutoff line CL1, and an own vehicle-lane side portion on the left side of the V-V line is formed as an upper stage cutoff line CL2 which is stepped up from the lower stage cutoff line CL1 via an inclined portion.

The low-beam light distribution pattern PL1 is formed by projecting the light source image of the light emitting element 13 formed on the rear focal plane of the projector lens 11 by the light emitted from the light emitting element 13 and reflected by the reflector 14, as inverted projected image, on the virtual vertical screen by the projector lens 11. The cutoff lines CL1, CL2 are formed as an inverted projected image of the front end edge 21*a*1 in the upward reflective surface 21*a* of the upper plate portion 21. That is, the front end edge 21*a*1 of the upward reflective surface 21*a* function as a shade for shielding a part of light emitted from the light emitting element 13 and directed to the projector lens 11 in order to form the cutoff lines CL1, CL2 of the low-beam light distribution pattern PL1.

In the low-beam light distribution pattern PL1, an elbow point E that is an intersection between the lower stage cutoff line CL1 and the V-V line is positioned at an angle of about 0.5° to 0.6° below the point H-V, for example.

In the high-beam light distribution pattern PH1, the additional light distribution pattern PA is additionally formed as a horizontally elongated light distribution pattern so as to spread upward from the cutoff lines CL1, CL2, thereby irradiating a travelling road in front of the vehicle in a wide range. The additional light distribution pattern PA is formed as a combined light distribution pattern of eleven light distribution patterns Pa. Each light distribution pattern Pa is a light distribution pattern which is formed as an inverted projected image of the light source image of each light emitting element formed on the rear focal plane of the projector lens 11 by the light emitted from each of the light emitting elements 31.

Each light distribution pattern Pa has a substantially rectangular shape slightly long in the upper-lower direction. Although the light emission surface of each light emitting element has a square shape, each light distribution pattern Pa has a substantially rectangular shape slightly long in the upper-lower direction because the light reflected by the reflective surfaces 21*b*, 21*a* is diffused upward and downward. Further, the respective light distribution patterns Pa are formed so as to slightly overlap with each other between adjacent light distribution patterns Pa. The reason is that the light emitting elements 31 are arranged behind the rear focal plane of the projector lens 11 and the range of the bundle of light beams passing through the rear focal plane of the projector lens 11 slightly overlaps between adjacent light emitting elements.

Furthermore, each light distribution pattern Pa is formed such that its lower end edge matches or partially overlaps with the cutoff lines CL1, CL2. The reason is that the downward reflective surface 21*b* for reflecting a part of light emitted from each of the light emitting elements 31 toward the front side is integrally formed with the upward reflective surface 21*a* so that the downward reflective surface 21*b* extends obliquely downward and rearward from the front end edge 21*a*1 of the upward reflective surface 21*a* to a position near the upper side of the light emitting elements 31. Further, the reason is that light (mainly from the light emitting elements 31) incident on the upper region 11A of the projector lens 11 is emitted as light (closer to the side of the low-beam light distribution pattern PL1) slightly downward from the upper exit surface 11*a* of the projector lens 11 by the curvature of the upper exit surface 11*a* being greatly curved.

The intermediate light distribution pattern PM1 shown in FIG. 8B is formed as a light distribution pattern having an additional light distribution pattern PAm in which a part of the additional light distribution pattern PA is missing, instead of the additional light distribution pattern PA.

The additional light distribution pattern PAm is formed as a light distribution pattern in which the third and fourth light distribution patterns Pa from the right side of the eleven light distribution patterns Pa are missing, for example. The additional light distribution pattern PAm is formed by turning off the third and fourth light emitting element from the left side of the eleven light emitting elements 31. When such an intermediate light distribution pattern PM1 is formed, the illumination light from the vehicle lamp 1 irradiates the travelling road in front of the vehicle as widely as possible within a range in which it does not give a glare to a driver of an on-coming vehicle 2 while being prevented from hitting the on-coming vehicle 2, for example. Further, as the position of the on-coming vehicle 2 changes, the shape of the additional light distribution pattern PAm is changed by sequentially switching the light emitting elements to be turned off. In this way, it is possible to maintain a state of widely irradiating the travelling road in front of the vehicle within a range in which it does not give a glare to a driver of the oncoming vehicle 2. Meanwhile, the presence of the oncoming vehicle 2 is detected by an in-vehicle camera or the like (not shown).

Figure 9A:
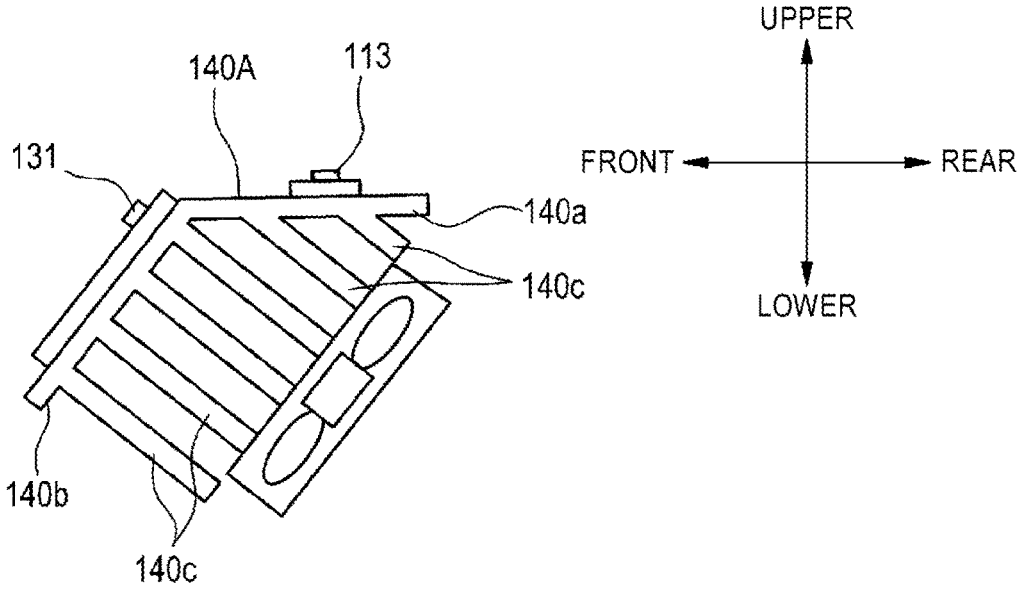
FIGS. 9A to 9C are views showing a reference example of the base member in the first and second embodiments.
Figure 9B:
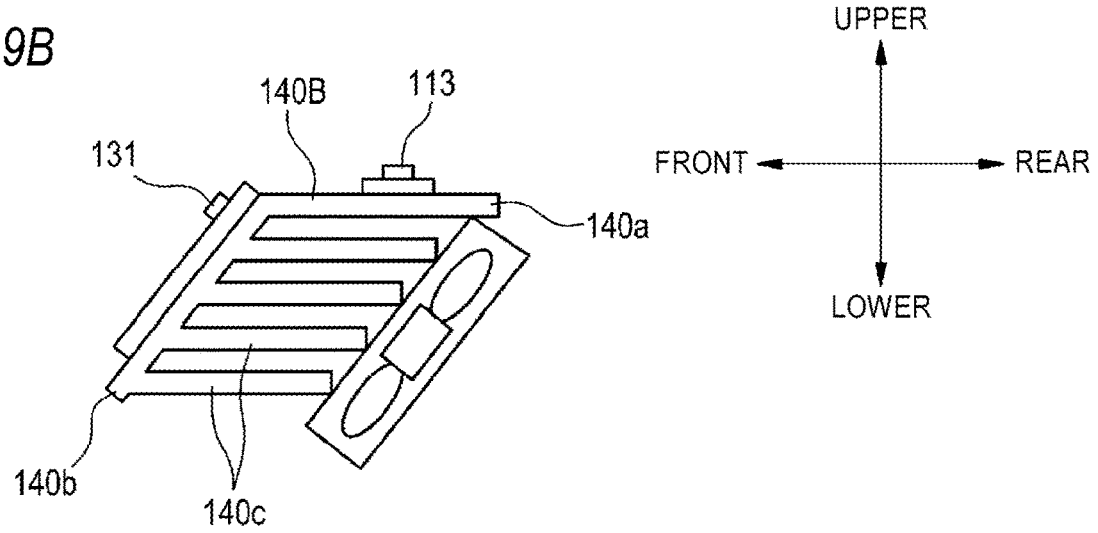
Figure 9C:
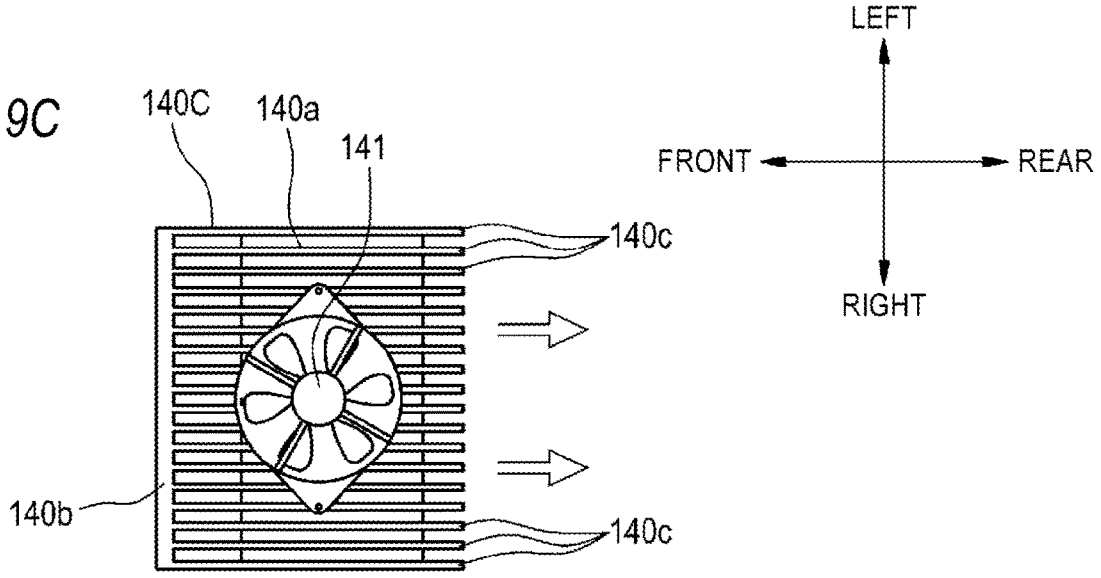

Meanwhile, in the first embodiment, in the configuration capable of selectively performing a low-beam irradiation and a high-beam irradiation by a projector type optical system using a single projector lens, the heat radiation for a light source (low-beam light source) configured to form a low-beam light distribution pattern and a light source (high-beam light source) configured to form an additional high-beam light distribution pattern becomes a problem as the size of the base member (heat sink) for heat radiation is reduced. As a method for enhancing the heat radiation property, it is conceivable to increase the surface area of the base member by forming a plurality of heat-radiation fins on the base member, for example. FIGS. 9A to 9C show reference examples of base members 140A, 140B, 140C, each of which includes an upper wall portion 140*a* extending in the horizontal direction, an inclined wall portion 140*b* extending obliquely downward and forward, and heat-radiation fins 140*c* formed on rear surfaces of the wall portions.

FIG. 9A is a longitudinal sectional view of the base member 140A, and the heat-radiation fins 140*c* are formed in a direction perpendicular to the inclined wall portion 140*b* on which a high-beam light source 131 is disposed. However, since it is required to fix a low-beam light source 113 and the high-beam light source 131 at predetermined positions, respectively, in this configuration, the number of heat-radiation fins 140*c* for releasing the heat of the low-beam light source 113 is small and the temperature rise of the low-beam light source 113 cannot be sufficiently suppressed. Further, when the number of heat-radiation fins 140*c* for releasing the heat of the low-beam light source 113 is increased, the size of the base member 140 becomes larger. FIG. 9B is a longitudinal sectional view of the base member 140B, and the heat-radiation fins 140*c* are formed in the horizontal direction, similarly to the upper wall portion 140*a* on which the low-beam light source 113 is disposed. However, in this configuration, since the heat-radiation fins 140*c* are not formed directly on the upper wall portion 140*a* and the heat transfer of the low-beam light source 113 is poor, the temperature rise of the low-beam light source 113 cannot be sufficiently suppressed. FIG. 9C is a bottom view of the base member, and the heat-radiation fins 140*c* extending in the front-rear direction and the upper-lower direction of the lamp are arranged along the left-right direction of the lamp. However, in this configuration, since the air fed from the air cooling fan 141 can be released only in the rearward direction (the direction indicated by the arrow) of the base member 140C, the temperature rise of the low-beam light source and the high-beam light source cannot be sufficiently suppressed. Further, air is not fed from the air cooling fan 141 to the heat-radiation fins 140*c* on the left and right ends, which do not face the air cooling fan 141. Thus, there is room for improvement in heat radiation property.

On the contrary, according to the vehicle lamp 1A of the first embodiment, as shown in FIG. 3, the heat-radiation fins 40*c* extending in the upper-lower direction of the lamp and the left-right direction of the lamp are arranged along the front-rear direction of the lamp on the rear surfaces of the upper wall portion 40*a* and the inclined wall portion 40*b* of the base member 40. Therefore, it is possible to form more heat-radiation fins 40*c* for releasing the heat of the light emitting element 13 and the light emitting elements 31 fixed at predetermined positions. Further, the air cooling fan 41 is accommodated in the concave region generated below the base member 40 due to the formation of the short fins 40*c*1 and can feed air toward each of the heat-radiation fins 40*c* in the front-rear direction of the lamp. Further, the base member 40 is configured to have opening portions between the heat-radiation fins 40*c* in the left-right direction of the lamp. Therefore, for the entire base member 40, air passing between the heat-radiation fins 40*c* can be released in both left-right directions of the lamp through the opening portions. In this manner, the heat of the light emitting element 13 and the light emitting elements 31 can be efficiently released to the outside through the opening portions, and the light emitting elements 13, 31 can be suppressed from being heated to a high temperature.

Further, in the second embodiment, for example, in the configuration capable of selectively performing a low-beam irradiation and a high-beam irradiation by a projector type optical system using a single projector lens, it is required to secure the heat radiation for a light source (low-beam light source) configured to form a low-beam light distribution pattern and a light source (high-beam light source) configured to form an additional high-beam light distribution pattern while reducing the size of the base member (heat sink) for heat radiation. As a method for enhancing the heat radiation property, it is conceivable to increase the surface area of the base member by forming a plurality of heat-radiation fins on the base member, for example. FIGS. 9A to 9C show reference examples of the base members 140A, 140B, 140C, each of which includes the upper wall portion 140*a* extending in the horizontal direction, the inclined wall portion 140*b* extending obliquely downward and forward, and heat-radiation fins 140*c* formed on rear surfaces of the wall portions.

FIG. 9A is a cross-sectional view of the base member 140A, and the heat-radiation fins 140*c* are formed in a direction perpendicular to the inclined wall portion 140*b* on which a high-beam light source 131 is disposed. However, since it is required to fix a low-beam light source 113 and the high-beam light source 131 at predetermined positions, respectively, in this configuration, the number of heat-radiation fins 140*c* for releasing the heat of the low-beam light source 113 is small and the temperature rise of the low-beam light source 113 cannot be sufficiently suppressed. Further, when the number of heat-radiation fins 140*c* for releasing the heat of the low-beam light source 113 is increased, the size of the base member 140A becomes larger. FIG. 9B is a cross-sectional view of the base member 140B, and the heat-radiation fins 140*c* are formed in the horizontal direction, similarly to the upper wall portion 140*a* on which the low-beam light source 113 is disposed. However, in this configuration, since the heat-radiation fins 140*c* are not formed directly on the upper wall portion 140*a* and the heat transfer of the low-beam light source 113 is poor, the temperature rise of the low-beam light source 113 cannot be sufficiently suppressed. FIG. 9C is a bottom view of the base member 140C, and the heat-radiation fins 140*c* extending in the front-rear direction and the upper-lower direction of the lamp are arranged along the left-right direction of the lamp. However, in this configuration, since the air fed from the air cooling fan 141 can be released only in the rearward direction (the direction indicated by the arrow) of the base member 140C, the temperature rise of the low-beam light source and the high-beam light source cannot be sufficiently suppressed.

Further, for example, in a configuration in which a low-beam irradiation and a high-beam irradiation can be selectively performed by a projector type optical system using a single projector lens, in order to obtain a good light distribution pattern, it is necessary to arrange a light source (high-beam light source) for forming an additional high-beam light distribution pattern as close as possible to the optical axis of the projector lens. In many cases, a surface mounting type light emitting diode (Light Emitting Diode) is adopted as the high-beam light source. At this time, heat radiation is improved by mounting the light emitting diode on a metal substrate having high thermal conductivity. However, when the LED is brought closer to the optical axis, the LED should be arranged on the end side of the metal substrate. Therefore, heat radiation performance is degraded, and the temperature of the light emitting diode or the solder for mounting rises.

On the contrary, according to the vehicle lamp 1B of the second embodiment, the heat-radiation fins 40*c* extending in the upper-lower direction of the lamp and the left-right direction of the lamp are arranged along the front-rear direction of the lamp on the rear surfaces of the upper wall portion 40*a* and the inclined wall portion 40*b* of the base member 40. Therefore, it is possible to form more heat-radiation fins 40*c* for releasing the heat of the light emitting element 13 and the light emitting elements 31 fixed at predetermined positions. Further, the base member 40 is configured to have opening portions between the heat-radiation fins 40*c* in the left-right direction of the lamp, and air passing between the heat-radiation fins 40*c* can be released in both left-right directions of the lamp through the opening portions. In this manner, heat of the light emitting element 13 and the light emitting elements 31 can be efficiently released to the outside through the opening portions.

Further, in the first and second embodiments, the thickness A of the wall portion of the first mounting portion 40*a*3 on which the light emitting element 13 is mounted and the thickness C of the wall portion of the second mounting portion 40*b*1 on which the light emitting elements 31 are mounted are greater than the thickness B and the thickness D of the wall portions of the portions on which the light emitting elements are not mounted. Therefore, heat of the light emitting element 13 and the light emitting elements 31 can be more efficiently radiated.

Further, since the air cooling fan 41 is disposed to face the tip end of the heat-radiation fins 40*c*, the air generated from the air cooling fan 41 can be efficiently fed between the heat-radiation fins 40*c*, and heat can be more efficiently radiated.

Further, the heat-radiation fins 40*c* include the short fins 40*c*1 having a short length and the long fins 40*c*2 having a long length, and the air cooling fan 41 is accommodated in the concave region generated below the base member 40 due to the formation of the short fins 40*c*1 and is disposed to face the tip ends of the shorts fin 40*c*1. Therefore, the size of the base member 40 can be reduced and heat can be efficiently radiated even with the short fins 40*c*1.

Further, since the pitch E between the short fins 40*c*1 is smaller than the pitch F between the long fins 40*c*2 and the fin adjacent thereto, the surface area of the heat-radiation fins in the region where the short fins 40*c*1 are formed can be increased, and heat can be more efficiently radiated.

Further, the light emitting elements 31 are mounted on the metal substrate 32 having high thermal conductivity. Therefore, the heat generated from the light emitting elements 31 can be efficiently transferred to the base member 40 via the substrate 32. Further, since the light emitting elements 31 are arranged in the left-right direction on the substrate 32, the heat of each of the light emitting elements 31 can be efficiently transferred to the base member 40.

Further, in the second embodiment, since the light emitting elements 31 are mounted on the metal substrate 32 having high thermal conductivity, the heat generated from the light emitting elements 31 can be efficiently transferred to the base member 40 via the substrate 32. Further, since the light emitting elements 31 are arranged in the left-right direction on the substrate 32, the heat of each of the light emitting elements 31 can be efficiently transferred to the base member 40.

Further, the ratio (A/Pmin) of the shortest distance A from the mounting portions 32*b* to the end portions 32*a*1 of the wiring patterns 32*a* to the minimum arrangement pitch Pmin of the light emitting elements 31 mounted on the substrate 32 is set to 0.57 or more, and the ratio (B/Pmin) of the shortest distance B from the mounting portions 32*b* to the end portion 32*c* of the substrate 32 to the minimum arrangement pitch Pmin is set to 1.7 or more. As a result, the light emitting elements 31 are suppressed from being heated to, for example, a temperature equal to or higher than the product condition even when the light source unit 30 is operated for a certain time or more under the high-beam irradiation. That is, it is possible to arrange the light emitting elements 31 as close as possible above the optical axis Ax while sufficiently securing a heat radiation area of the substrate 32 in order to suppress the temperature rise of the light emitting elements 31.

With such a configuration, in the vehicle lamp 1B, even during the high-beam irradiation in which the light emitting element 13 and the light emitting elements 31 are turned on, the temperature of the light emitting elements 31 and the temperature of the solder serving as power feeding paths of the light emitting elements 31 are set to be lower than the temperature of the light emitting element 13. In this way, the light emitting elements 31 and the light emitting element 13 can be suppressed from being heated to a high temperature.

Furthermore, in the third embodiment, in the configuration of the lamp capable of selectively performing a low-beam irradiation and a high-beam irradiation by a projector type optical system using a single projector lens, the lens holder for holding the projector lens is often fixed to the base member of the lamp. Since a light source (low-beam light source) for forming a low-beam light distribution pattern and a light source (high-beam light source) for forming an additional high-beam light distribution pattern are also fixed to the base member, it is desirable that a structure for fixing the lens holder is not disposed on the front side of the base member in order to secure arrangement spaces of the light source and the parts related to the light source.

On the contrary, according to the vehicle lamp 1C of the third embodiment, the lens holder 12 has the semi-annular arm portion 12*c* extending from the holding portion 12*b* toward the rear of the lamp and is fixed to the upper wall portion 40*a* of the base member 40 via the arm portion 12*c*. Therefore, even when the structure for fixing the lens holder 12 is not disposed on the front side of the base member 40, the lens holder 12 can be fixed to the base member 40. In this manner, it is possible to obtain a configuration in which the lens holder 12 and the parts disposed on the inclined wall portion 40*b* of the base member 40 are hard to interfere with each other. As a result, the parts such as the optical member 20 associated with the light emitting elements 31, the power supply terminal 33 and the connection cable can be easily arranged on the inclined wall portion 40*b*.

Further, the semi-annular arm portion 12*c* is fixed to the upper wall portion 40*a* of the base member 40 via three fixing portions 15*a*, 15*b*, 15*c*. The end portion of the arm portion 12*c* on the rear side of the lamp is fixed by the fixing portion 15*b*. On the other hand, in a state where the projector lens 11 and the reflector 14 are attached to the lens holder 12, the position of the center of gravity G of the structure configured by the lens holder 12, the projector lens 11 and the reflector 14 is located on the front side of the center of the structure. Therefore, even the structure in which the position of the center of gravity G is biased to the front side can be stably fixed by the fixation of this embodiment.

Further, since the reflector 14 is fixed on the arm portion 12*c* of the lens holder 12, a separate boss for fixing the reflector 14 may not be provided on the base member 40. Therefore, the number of bosses provided on the base member 40 can be reduced, the heat-radiation property of the base member 40 can be enhanced, and the size of the base member 40 can be reduced.

Further, the position of the center of gravity G of the structure configured by the lens holder 12, the projector lens 11 and the reflector 14 is located in front of the lamp from the tip end 40*f* of the upper wall portion 40*a* of the base member 40 on the front side of the lamp. On the other hand, since the front portion of the base member 40 is formed as the inclined wall portion 40*b*, the position of the center of gravity of the base member 40 is located on the rear side of the lamp from the tip end 40*f* of the upper wall portion 40*a*. Therefore, the position of the center of gravity of the entire lamp in which the structure is fixed to the base member 40 is located at a position close to the center of the entire lamp structure. In this manner, it is possible to improve the stability of the lamp after being installed on a vehicle.

Further, the light emission surfaces of the light emitting elements 31 disposed on the inclined wall portion 40*b* of the base member 40 are fixed at positions on the lower and rear side of the rear focal point F so as to face obliquely forward and upward. Therefore, most of light emitted from the light emitting elements 31 is allowed to pass through the vicinity of the rear focal point F while placing the positions of the light emitting elements 31 at positions avoiding a path of light for forming the low-beam light distribution pattern PL. In this way, the utilization efficiency of light of the light emitting elements 31 can be improved, and the size of the structure of the lamp can be reduced.

Further, since the light emitting elements 31 are disposed on the inclined wall portion 40*b* of the base member 40 via the substrate 32, the heat generated from the light emitting elements 31 can be efficiently transferred to the base member 40 via the substrate 32, and the size of the structure of the lamp can be reduced.

Further, since the lens holder 12 can be fixed to the upper portion (the protruding portion 40*e*) of one fixing portion 40*d* provided in the base member 40 and the air cooling fan 41 can be fixed to the lower portion thereof, the length in the front-rear direction of the lamp can be shortened.

According to the vehicle lamp 1C having such a configuration, it is possible to improve the degree of freedom in designing the position where each part of the lamp is attached to the base member 40.

Meanwhile, the disclosure is not limited to the above-described embodiments, but can be appropriately deformed or improved. In addition, the materials, shapes, dimensions, numerical values, modes, quantities, and locations and the like of the respective components in the above-described embodiments are arbitrary and not limited as long as they can achieve the disclosure.

Figure 10A:
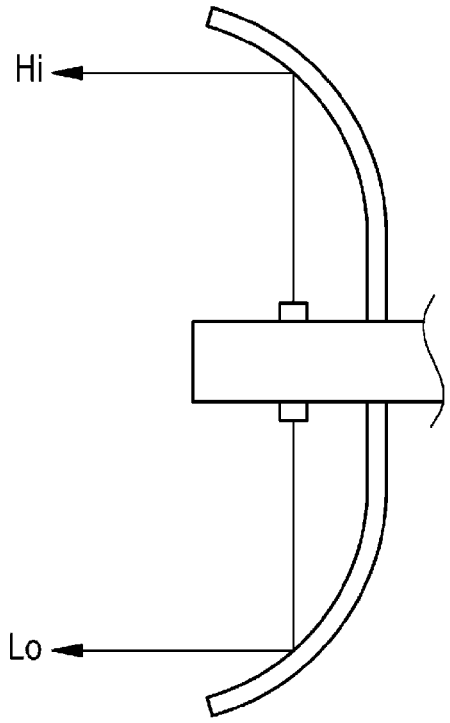
FIGS. 10A and 10B are views for explaining modifications of a vehicle lamp 1.
Figure 10B:
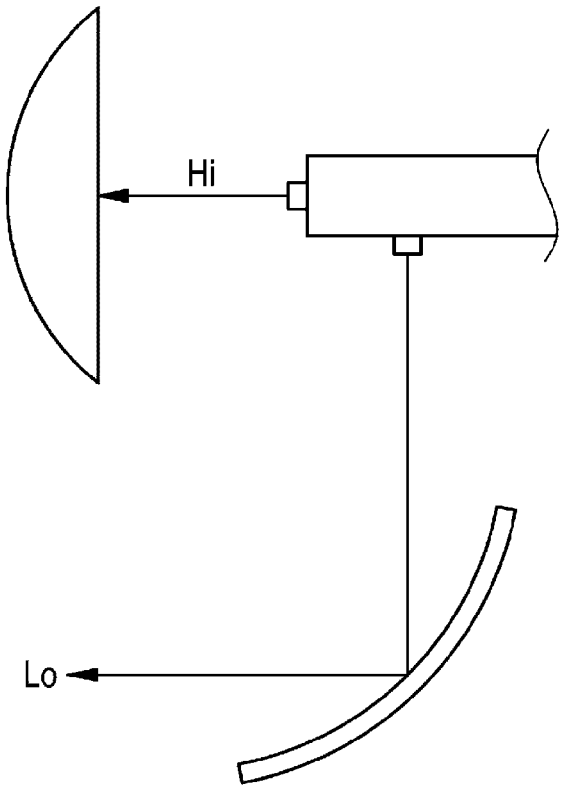

In the above-described first to third embodiments, it has been described that the vehicle lamp 1 as a projector type lamp unit is a headlamp capable of selectively performing a low-beam irradiation and a high-beam irradiation. However, the example to which the disclosure is applied is not limited to this. For example, the disclosure may be applied to a parabola type lamp unit (see FIG. 10A) or may be applied to a combined lamp unit of a projector type and a parabola type (see FIG. 10B). Further, the disclosure is not limited to the headlamp, but may be applied to lamps for other uses, such as DRL (Daytime Running Lamps), clearance lamps and fog lamps.

The present application is based on Japanese Patent Application No. 2015-244414 filed on Dec. 15, 2015, Japanese Patent Application No. 2015-244415 filed on Dec. 15, 2015, and Japanese Patent Application No. 2015-244416 filed on Dec. 15, 2015, the contents of which are incorporated herein as a reference.

The invention claimed is:

1. A vehicle lamp configured to selectively perform a low-beam irradiation and a high-beam irradiation, the vehicle lamp comprising:

a projector lens;

a first light source disposed behind the projector lens and configured to emit light for forming a low-beam light distribution pattern;

a second light source disposed behind the projector lens and configured to emit light for forming an additional high-beam light distribution pattern; and a metal base member on which the first light source and the second light source are disposed, wherein the base member includes a first surface on which the first light source is disposed and a second surface on which the second light source is disposed, wherein the second surface is an inclined surface inclined with respect to an optical axis of the projector lens such that an emission portion of the second light source disposed on the second surface faces obliquely forward and upward, wherein a plurality of metal plate-shaped fins extending in a left-right direction of the lamp in length of the plurality of metal plate-shaped fins and an upper-lower direction of the lamp in width of the plurality of metal plate-shaped fins are arranged along a front-rear direction of the lamp in thickness of the plurality of metal plate-shaped fins on a first rear surface of the base member opposite to the first surface of the base member and a second rear surface of the base member opposite to the second surface of the base member, wherein the second light source comprises a plurality of light emitting elements arranged in the left-right direction, and light emitted from the plurality of light emitting elements is incident on substantially the entire area of an incident surface of the projector lens, wherein the plurality of metal plate-shaped fins include:

first metal plate-shaped fins protruding at edges of the first and second rear surfaces of the base member along the front-rear direction; and second metal plate-shaped fins provided between the first metal plate-shaped fins along the front-rear direction and protruding from the first and second rear surfaces of the base member and wherein a length of the first metal plate-shaped fins in the upper-lower direction of the lamp is longer than that of at least one of the second metal plate-shaped fins.

2. The vehicle lamp according to claim 1, wherein the first surface includes a first mounting surface on which the first light source is mounted, and wherein a thickness of the base member defined by a distance between the first mounting surface and the rear surface of the first surface is larger than a thickness of the base member defined by a distance between a surface on the first surface where the first light source is not mounted and the rear surface of the first surface, the first mounting surface protruding from the surface on the first surface where the first light source is not mounted.

3. The vehicle lamp according to claim 1, wherein the second surface includes a second mounting surface on which the second light source is mounted, and wherein a thickness of the base member defined by a distance between the second mounting surface and the rear surface of the second surface is larger than a thickness of the base member defined by a distance between a surface on the second surface where the second light source is not mounted and the rear surface of the second surface, the second mounting surface protruding from the second surface where the second light source is not mounted.

4. The vehicle lamp according to claim 1, further comprising:

an air cooling fan, and wherein the air cooling fan is disposed to face tip ends of the plurality of metal plate-shaped fins.

5. The vehicle lamp according to claim 4, wherein the air cooling fan is disposed to face tip ends of the second metal plate-shaped fins amongst the first and second metal plate-shaped fins.

6. The vehicle lamp according to claim 5, wherein a pitch between the second metal plate-shaped fins is smaller than a pitch between the first metal plate-shaped fins.

7. The vehicle lamp according to claim 1, wherein the second light source further includes a metal substrate on which the plurality of light emitting elements are disposed, wherein the substrate is fixed to the second surface, and wherein the plurality of light emitting elements are disposed on the second surface via the substrate.

8. The vehicle lamp according to claim 7, wherein the plurality of light emitting elements are arranged in the left-right direction below a rear focal point of the projector lens and configured to be individually turned on.

9. A vehicle lamp comprising:

a first light source;

a second light source;

one or more optical parts configured to irradiate light from the first light source and the second light source toward a front of the lamp; and a metal base member on which the first light source and the second light source are disposed, wherein the base member includes a first surface on which the first light source is disposed, a second surface on which the second light source is disposed, and a heat-radiation portion formed on a first rear surface of the base member opposite to the first surface and a rear second surface of the base member opposite to the second surface, wherein the second light source includes a light emitting element and a metal substrate on which the light emitting element is disposed, wherein the substrate includes:

a wiring pattern; and a mounting portion provided on the wiring pattern, wherein the light emitting element is mounted on the mounting portion of the substrate via a solder, wherein the first light source is fixed to the first surface by means different from a solder, wherein in a state where the first light source and the second light source are turned on, a temperature of the solder is caused to be lower than a temperature of the first light source by the heat-radiation portion, wherein the first surface includes a first mounting surface on which the first light source is mounted, and wherein a thickness of the base member defined by a distance between the first mounting surface and the first rear surface of the base member is larger than a thickness of the base member defined by a distance between a surface on the first surface where the first light source is not mounted and the first rear surface of the base member, the first mounting surface protruding from the surface on the first surface where the first light source is not mounted.

10. A vehicle lamp comprising:

a projector lens;

a lens holder configured to support the projector lens;

a first light source disposed behind the projector lens;

a second light source disposed behind the projector lens; and a base member on which the first light source and the second light source are disposed, wherein the base member includes a first surface on which the first light source is disposed and a second surface on which the second light source is disposed, wherein the lens holder includes an arm surface, wherein the arm surface includes a right arm surface extending from a right portion of the lens holder toward a front of the lamp and a left arm surface extending from a left portion of the lens holder toward the front of the lamp, wherein the right arm surface and the left arm surface are directly connected to each other, wherein the arm surface is disposed on the first surface of the base member and fixed onto the first surface of the base member on which the first light source is disposed, and wherein the second light source comprises a plurality of light emitting elements arranged in a left-right direction, and light emitted from the plurality of light emitting elements is incident on substantially the entire area of an incident surface of the projector lens.

11. The vehicle lamp according to claim 10, wherein the arm surface is fixed on the first surface via at least three fixing portions.

12. The vehicle lamp according to claim 11, wherein one of the at least three fixing portions is formed on an end portion of the arm surface on a rear side of the lamp.

13. The vehicle lamp according to claim 10, further comprising:

a reflector configured to reflect light emitted from the first light source toward the projector lens, wherein the reflector is fixed on the arm surface.

14. The vehicle lamp according to claim 10, wherein the second surface is an inclined surface inclined with respect to an optical axis of the projector lens such that an emission portion of the second light source disposed on the second surface faces obliquely forward and upward and the emission portion of the second light source is disposed below a rear focal point of the projector lens.

15. The vehicle lamp according to claim 10, wherein the second surface is an inclined surface inclined with respect to an optical axis of the projector lens such that an emission portion of the second light source disposed on the second surface faces obliquely forward and upward and the emission portion of the second light source is disposed below a rear focal point of the projector lens.

16. The vehicle lamp according to claim 10, wherein the second light source includes a plurality of light emitting elements and a substrate on which the plurality of light emitting elements are disposed, wherein the substrate is fixed to the second surface, and wherein the plurality of light emitting elements are disposed on the second surface via the substrate.

17. The vehicle lamp according to claim 12, further comprising:

an air cooling fan;

wherein a plurality of metal plate-shaped fins are formed on a rear surface of the first surface and a rear surface of the second surface of the base member, wherein the air cooling fan is disposed to face tip ends of the fins, wherein a part of a fixing portion for fixing the air cooling fan to the base member includes a protruding portion extending from above the first surface to an upper side of the lamp, and wherein the fixing portion formed on the end portion of the arm surface on the rear side of the lamp is a fitting hole to be fitted to the protruding portion.

* * * * *